US011074765B1

(12) United States Patent
Bortnak et al.

(10) Patent No.: US 11,074,765 B1
(45) **Date of Patent: *Jul. 27, 2021**

(54) SYSTEMS AND METHODS FOR ACTIVATION OF POSTAGE INDICIA AT POINT OF SALE

(71) Applicant: Stamps.com, El Segundo, CA (US)

(72) Inventors: James Michael Bortnak, Santa Barbara, CA (US); Kenneth Thomas McBride, Palos Verdes Estates, CA (US)

(73) Assignee: Stamps.com Inc., El Segundo, CA (US)

( * ) Notice: Subject to any disclaimer, the term of this patent is extended or adjusted under 35 U.S.C. 154(b) by 49 days.

This patent is subject to a terminal disclaimer.

(21) Appl. No.: 16/432,817

(22) Filed: Jun. 5, 2019

Related U.S. Application Data

(63) Continuation of application No. 15/960,474, filed on Apr. 23, 2018, now Pat. No. 10,424,126, which is a (Continued)

(51) Int. Cl.
*G07B 17/00* (2006.01)

(52) U.S. Cl.
CPC ..... *G07B 17/00* (2013.01); *G07B 17/00362* (2013.01); *G07B 17/00508* (2013.01); (Continued)

(58) Field of Classification Search
CPC ..... G07B 17/00; G07B 17/00362; G07B 17/00508; G07B 2017/00201; (Continued)

(56) References Cited

U.S. PATENT DOCUMENTS 1,684,756 A 9/1928 Close
1,988,908 A 1/1935 MacKinnon
(Continued)

FOREIGN PATENT DOCUMENTS

DE 4409386 A1 9/1995
EP 0137737 A2 4/1985
(Continued)

OTHER PUBLICATIONS

Stump, Jake, "Postal Service to remove stamp machines across the country:: They broke down often and were hard to repair, official says," Charleston Daily Mail, C1, Charleston, WV, Charleston Newspapers, Mar. 19, 2008.*
(Continued)

*Primary Examiner* — Nathan Erb
(74) *Attorney, Agent, or Firm* — Norton Rose Fulbright US LLP

(57) ABSTRACT

Systems and methods which provide for activation of postage indicia at a point of sale are shown. In operation according to embodiments, unassigned (e.g., not yet activated or not yet representing postage value) tokens (e.g., IBI barcodes) suitable for later use as postage indicia are distributed to various point of sale locations, such as retail locations, consumer kiosks, vending machines, etc. and made available for purchase by users. Upon purchase, at a point of sale, such unassigned tokens are preferably activated as valid or "live" postage indicia. Thereafter, the postage indicia may be used to post mail items.

20 Claims, 5 Drawing Sheets

Related U.S. Application Data continuation of application No. 12/103,496, filed on Apr. 15, 2008, now Pat. No. 9,978,185.

(52) U.S. Cl.
CPC ..... *G07B 2017/0037* (2013.01); *G07B 2017/0058* (2013.01); *G07B 2017/00201* (2013.01); *G07B 2017/00225* (2013.01); *G07B 2017/00709* (2013.01)

(58) Field of Classification Search
CPC .. G07B 2017/00225; G07B 2017/0037; G07B 2017/0058; G07B 2017/00709
See application file for complete search history.

(56) References Cited

U.S. PATENT DOCUMENTS 2,825,498 A 3/1958 Alves
2,887,326 A 5/1959 Kramer
2,964,232 A 12/1960 Levyn
3,111,084 A 11/1963 Ridenour et al.
3,221,980 A 12/1965 Mercur
3,380,648 A 4/1968 De Lyra
3,584,696 A 6/1971 Eblowitz
3,594,727 A 7/1971 Braun
3,658,239 A 4/1972 Foutz
3,691,726 A 9/1972 Stephens et al.
3,747,837 A 7/1973 Wilson
3,938,095 A 2/1976 Check, Jr. et al.
3,978,457 A 8/1976 Check, Jr. et al.
4,119,194 A 10/1978 Freeman et al.
4,201,339 A 5/1980 Gunn
4,245,775 A 1/1981 Conn
4,253,158 A 2/1981 McFiggans
4,271,481 A 6/1981 Check, Jr. et al.
4,306,299 A 12/1981 Check, Jr. et al.
4,376,299 A 3/1983 Rivest
4,511,793 A 4/1985 Racanelli
4,565,317 A 1/1986 Kranz
4,629,871 A 12/1986 Scribner et al.
4,641,347 A 2/1987 Clark et al.
4,649,266 A 3/1987 Eckert
4,661,001 A 4/1987 Takai et al.
4,709,850 A 12/1987 Wagner
4,725,718 A 2/1988 Sansone et al.
4,743,747 A 5/1988 Fougere et al.
4,744,554 A 5/1988 Kulpa et al.
4,757,537 A 7/1988 Edelmann et al.
4,760,532 A 7/1988 Sansone et al.
4,763,271 A 8/1988 Field
4,775,246 A 10/1988 Edelmann et al.
4,784,317 A 11/1988 Chen et al.
4,800,506 A 1/1989 Axelrod et al.
4,802,218 A 1/1989 Wright et al.
4,812,994 A 3/1989 Taylor et al.
4,821,195 A 4/1989 Baer et al.
4,831,554 A 5/1989 Storace et al.
4,831,555 A 5/1989 Sansone et al.
4,837,701 A 6/1989 Sansone et al.
4,853,865 A 8/1989 Sansone et al.
4,858,138 A 8/1989 Talmadge
4,862,386 A 8/1989 Axelrod et al.
4,864,618 A 9/1989 Wright et al.
4,868,757 A 9/1989 Gil
4,872,705 A 10/1989 Hartfeil
4,872,706 A 10/1989 Brewen et al.
4,873,645 A 10/1989 Hunter et al.
4,875,174 A 10/1989 Olodort et al.
4,893,249 A 1/1990 Silverberg
4,900,903 A 2/1990 Wright et al.
4,900,904 A 2/1990 Wright et al.
4,900,941 A 2/1990 Barton et al.
4,901,241 A 2/1990 Schneck
4,908,770 A 3/1990 Breault et al.
4,910,686 A 3/1990 Chang et al.
4,919,325 A 4/1990 Culver
4,933,849 A 6/1990 Connell et al.
4,934,846 A 6/1990 Gilham
4,941,091 A 7/1990 Breault et al.
4,947,333 A 8/1990 Sansone et al.
4,993,752 A 2/1991 Juszak
4,998,204 A 3/1991 Sansone et al.
5,025,141 A 6/1991 Bolan
5,044,669 A 9/1991 Berry
5,058,008 A 10/1991 Schumacher
5,065,000 A 11/1991 Pusic
5,067,088 A 11/1991 Schneiderhan
5,075,862 A 12/1991 Doeberl et al.
5,077,792 A 12/1991 Herring
5,085,470 A 2/1992 Peach et al.
5,091,771 A 2/1992 Bolan et al.
5,111,030 A 5/1992 Brasington et al.
5,119,306 A 6/1992 Metelits et al.
5,136,647 A 8/1992 Haber et al.
5,150,407 A 9/1992 Chan
5,200,903 A 4/1993 Gilham et al.
5,202,834 A 4/1993 Gilham
5,233,657 A 8/1993 Gunther
5,237,506 A 8/1993 Horbal et al.
5,239,168 A 8/1993 Durst, Jr. et al.
5,289,540 A 2/1994 Jones
5,316,208 A 5/1994 Petkovsek
5,319,562 A 6/1994 Whitehouse
5,323,323 A 6/1994 Gilham
5,323,465 A 6/1994 Avarne
5,341,505 A 8/1994 Whitehouse
5,360,628 A 11/1994 Butland
5,375,172 A 12/1994 Chrosny
5,384,886 A 1/1995 Rourke
5,388,049 A 2/1995 Sansone et al.
5,390,849 A 2/1995 Frissard
5,410,642 A 4/1995 Hakamatsuka et al.
5,423,573 A 6/1995 de Passille
5,425,586 A 6/1995 Berson
5,437,441 A 8/1995 Tuhro et al.
5,439,721 A 8/1995 Pedroli et al.
5,449,200 A 9/1995 Andric et al.
5,454,038 A 9/1995 Cordery et al.
5,471,925 A 12/1995 Heinrich et al.
5,476,420 A 12/1995 Manning
5,490,077 A 2/1996 Freytag
5,494,445 A 2/1996 Sekiguchi et al.
5,501,393 A 3/1996 Walz
5,502,304 A 3/1996 Berson et al.
5,510,992 A 4/1996 Kara
5,524,995 A 6/1996 Brookner et al.
5,554,842 A 9/1996 Connell et al.
5,569,317 A 10/1996 Sarada et al.
5,573,277 A 11/1996 Petkovsek
5,583,779 A 12/1996 Naclerio et al.
5,598,970 A 2/1997 Mudry et al.
5,600,562 A 2/1997 Guenther
5,601,313 A 2/1997 Konkol et al.
5,602,743 A 2/1997 Fraytag
5,606,507 A 2/1997 Kara
5,606,613 A 2/1997 Lee et al.
5,612,541 A 3/1997 Hoffmann et al.
5,612,889 A 3/1997 Pintsov et al.
5,615,123 A 3/1997 Davidson et al.
5,615,312 A 3/1997 Kohler
5,617,519 A 4/1997 Herbert
5,619,571 A 4/1997 Sandstrom et al.
5,623,546 A 4/1997 Hardy et al.
5,635,694 A 6/1997 Tuhro
5,649,118 A 7/1997 Carlisle et al.
5,650,934 A 7/1997 Manduley
5,651,238 A 7/1997 Belec et al.
5,655,023 A 8/1997 Cordery et al.
5,666,215 A 9/1997 Fredlund et al.
5,666,284 A 9/1997 Kara
5,682,318 A 10/1997 Kara
5,696,829 A 12/1997 Cordery et al.
5,706,502 A 1/1998 Foley et al.

(56) References Cited

U.S. PATENT DOCUMENTS 5,708,422 A 1/1998 Blonder et al.
5,715,314 A 2/1998 Payne et al.
5,717,596 A 2/1998 Bernard et al.
5,717,597 A 2/1998 Kara
5,717,980 A 2/1998 Oka et al.
5,729,460 A 3/1998 Plett et al.
5,737,729 A 4/1998 Denman
5,742,683 A 4/1998 Lee et al.
5,768,132 A 6/1998 Cordery et al.
5,774,886 A 6/1998 Kara
5,778,076 A 7/1998 Kara et al.
5,791,553 A 8/1998 Fabel
5,796,834 A 8/1998 Whitney et al.
5,801,364 A 9/1998 Kara et al.
5,801,944 A 9/1998 Kara
5,805,810 A 9/1998 Maxwell
5,812,991 A 9/1998 Kara
5,819,240 A 10/1998 Kara
5,822,739 A 10/1998 Kara
5,825,893 A 10/1998 Kara
5,836,617 A 11/1998 Beaudoin et al.
5,860,068 A 1/1999 Cook
5,884,277 A 3/1999 Khosla
5,902,439 A 5/1999 Pike et al.
5,923,406 A 7/1999 Brasington et al.
5,923,885 A 7/1999 Johnson et al.
5,924,738 A 7/1999 Konkol et al.
5,929,415 A 7/1999 Berson
5,932,139 A 8/1999 Oshima et al.
5,936,865 A 8/1999 Pintsov et al.
5,936,885 A 8/1999 Morita et al.
5,946,671 A 8/1999 Herring
5,960,418 A 9/1999 Kelly et al.
5,983,209 A 11/1999 Kara
5,995,985 A 11/1999 Cai
6,005,945 A 12/1999 Whitehouse
6,010,069 A 1/2000 Debois
6,010,156 A 1/2000 Block
6,026,385 A 2/2000 Harvey et al.
6,033,751 A 3/2000 Kline
6,061,670 A 5/2000 Brand
D434,438 S 11/2000 Kara
6,142,380 A 11/2000 Sansone et al.
6,155,476 A 12/2000 Fabel
6,173,888 B1 1/2001 Fabel
6,175,826 B1 1/2001 Malandra, Jr. et al.
6,181,433 B1 1/2001 Hayama et al.
6,184,534 B1 2/2001 Stephany et al.
6,199,055 B1 3/2001 Kara et al.
6,208,980 B1 3/2001 Kara
6,209,779 B1 4/2001 Fabel
6,233,565 B1 5/2001 Lewis et al.
6,234,694 B1 5/2001 Brookner
6,244,763 B1 6/2001 Miller
6,249,777 B1 6/2001 Kara et al.
6,296,404 B1 10/2001 Pierce et al.
6,311,240 B1 10/2001 Boone et al.
6,322,192 B1 11/2001 Walker
6,370,844 B1 4/2002 Stricker
6,385,504 B1 5/2002 Pintsov et al.
6,397,328 B1 5/2002 Pitchenik et al.
6,415,983 B1 7/2002 Ulvr et al.
6,427,021 B1 7/2002 Fischer et al.
6,428,219 B1 8/2002 Stier et al.
6,430,543 B1 8/2002 Lee et al.
6,438,530 B1 8/2002 Heiden et al.
6,461,063 B1 10/2002 Miller et al.
6,505,179 B1 1/2003 Kara
6,505,980 B1 1/2003 Allday
6,523,014 B1 2/2003 Pauschinger
6,526,391 B1 2/2003 Cordery et al.
6,532,452 B1 3/2003 Pintsov et al.
6,594,374 B1 7/2003 Beckstrom et al.
6,595,412 B2 7/2003 Manduley
6,655,579 B1 12/2003 Delman et al.
6,671,813 B2 12/2003 Ananda
6,692,031 B2 2/2004 McGrew
6,697,822 B1 2/2004 Armatis et al.
6,701,304 B2 3/2004 Leon
6,722,563 B1 4/2004 Johnson et al.
6,735,575 B1 5/2004 Kara
6,820,201 B1 11/2004 Lincoln et al.
6,834,112 B1 12/2004 Brickell
6,834,273 B1 12/2004 Sansone et al.
6,853,990 B1 2/2005 Thiel
6,868,406 B1 3/2005 Ogg et al.
6,902,265 B2 6/2005 Critelli et al.
6,904,168 B1 6/2005 Steinberg et al.
6,945,458 B1 9/2005 Shah et al.
6,946,960 B2 9/2005 Sisson et al.
6,948,660 B2 9/2005 Critelli et al.
7,028,902 B2 4/2006 Xu et al.
7,039,214 B2 5/2006 Miller et al.
7,069,253 B2 6/2006 Leon
7,085,725 B1 8/2006 Leon
7,117,363 B2 10/2006 Lincoln et al.
7,127,434 B2 10/2006 Burningham
7,149,726 B1 12/2006 Lingle et al.
7,162,460 B2 1/2007 Cleckler et al.
7,182,259 B2 2/2007 Lubow et al.
7,191,158 B2 3/2007 Ogg
7,191,336 B2 3/2007 Zeller et al.
7,194,957 B1 3/2007 Leon et al.
7,201,305 B1 4/2007 Correa
7,222,236 B1 5/2007 Pagel
7,225,170 B1 5/2007 Ryan, Jr.
7,233,929 B1 6/2007 Lingle et al.
7,234,645 B2 6/2007 Silverbrook et al.
7,243,842 B1 7/2007 Leon et al.
7,266,531 B2 9/2007 Pintsov et al.
7,305,556 B2 12/2007 Slick et al.
7,337,152 B1 2/2008 Gawler
7,343,357 B1 3/2008 Kara
7,396,048 B2 7/2008 Janetzke et al.
7,418,599 B2 8/2008 Peters
7,458,612 B1 12/2008 Bennett
7,509,291 B2 3/2009 McBride et al.
7,548,612 B2 6/2009 Weissman et al.
7,577,618 B2 8/2009 Raju et al.
7,711,650 B1 5/2010 Kara
7,778,924 B1 8/2010 Ananda
7,784,090 B2 8/2010 Lord et al.
7,828,223 B1 11/2010 Leon et al.
7,831,518 B2 11/2010 Montgomery et al.
7,831,524 B2 11/2010 Whitehouse
7,954,709 B1 6/2011 Leon et al.
7,963,437 B1 6/2011 McBride et al.
8,100,324 B1 1/2012 Leon
8,155,976 B1 4/2012 Rendich et al.
8,204,835 B1 6/2012 Ogg
8,240,579 B1 8/2012 Bennett
8,285,651 B1 10/2012 Leon et al.
8,612,361 B1 12/2013 Bussell et al.
8,626,673 B1 1/2014 Bennett
8,775,331 B1 7/2014 Tsuie et al.
9,911,246 B1 3/2018 McBride et al.
9,978,185 B1 * 5/2018 Bortnak ..... G07B 17/00362
10,424,126 B2 * 9/2019 Bortnak ..... G07B 17/00
2001/0007086 A1 7/2001 Rogers et al.
2001/0020234 A1 9/2001 Shah et al.
2001/0022060 A1 9/2001 Robertson et al.
2001/0032881 A1 10/2001 Wells et al.
2001/0042052 A1 11/2001 Leon
2001/0054153 A1 12/2001 Wheeler et al.
2002/0023057 A1 2/2002 Goodwin et al.
2002/0032668 A1 3/2002 Kohler et al.
2002/0032784 A1 3/2002 Darago et al.
2002/0033598 A1 3/2002 Beasley
2002/0046195 A1 4/2002 Martin et al.
2002/0052841 A1 5/2002 Guthrie et al.
2002/0070149 A1 6/2002 Schererz et al.
2002/0073039 A1 6/2002 Ogg et al.
2002/0073050 A1 6/2002 Gusler et al.
2002/0082935 A1 6/2002 Moore et al.

(56) References Cited

U.S. PATENT DOCUMENTS

| | | | |
|---|---|---|---|
| 2002/0083020 | A1 | 6/2002 | Leon |
| 2002/0083021 | A1 | 6/2002 | Ryan et al. |
| 2002/0099652 | A1 | 7/2002 | Herzen et al. |
| 2002/0143431 | A1 | 10/2002 | Sansone |
| 2002/0149195 | A1 | 10/2002 | Beasley |
| 2002/0190117 | A1 | 12/2002 | Manduley |
| 2003/0002709 | A1 | 1/2003 | Wu |
| 2003/0029914 | A1 | 2/2003 | Hartman et al. |
| 2003/0030270 | A1 | 2/2003 | Franko et al. |
| 2003/0037008 | A1 | 2/2003 | Raju et al. |
| 2003/0059635 | A1 | 3/2003 | Naasani |
| 2003/0078893 | A1 | 4/2003 | Shah et al. |
| 2003/0080182 | A1 | 5/2003 | Gunther |
| 2003/0088426 | A1 | 5/2003 | Benson et al. |
| 2003/0101143 | A1 | 5/2003 | Montgomery et al. |
| 2003/0101147 | A1 | 5/2003 | Montgomery et al. |
| 2003/0101148 | A1 | 5/2003 | Montgomery et al. |
| 2003/0115162 | A1 | 6/2003 | Konick |
| 2003/0138345 | A1 | 7/2003 | Schwabe |
| 2003/0140017 | A1 | 7/2003 | Patton et al. |
| 2003/0144972 | A1 | 7/2003 | Cordery et al. |
| 2003/0167241 | A1 | 9/2003 | Gilham |
| 2003/0182155 | A1 | 9/2003 | Nitzan et al. |
| 2003/0187666 | A1 | 10/2003 | Leon |
| 2003/0204477 | A1 | 10/2003 | McNett |
| 2003/0233276 | A1 | 12/2003 | Pearlman et al. |
| 2003/0236709 | A1 | 12/2003 | Hendra et al. |
| 2004/0000787 | A1 | 1/2004 | Vig et al. |
| 2004/0002926 | A1 | 1/2004 | Coffy et al. |
| 2004/0048503 | A1 | 3/2004 | Mills et al. |
| 2004/0064422 | A1 | 4/2004 | Leon |
| 2004/0070194 | A1 | 4/2004 | Janetzke et al. |
| 2004/0083179 | A1 | 4/2004 | Sesek et al. |
| 2004/0089482 | A1 | 5/2004 | Ramsden et al. |
| 2004/0112950 | A1 | 6/2004 | Manduley et al. |
| 2004/0122776 | A1 | 6/2004 | Sansone |
| 2004/0122779 | A1 | 6/2004 | Stickler et al. |
| 2004/0125413 | A1 | 7/2004 | Cordery |
| 2004/0128264 | A1 | 7/2004 | Leung et al. |
| 2004/0174012 | A1 | 9/2004 | Hagen |
| 2004/0185827 | A1 | 9/2004 | Parks |
| 2004/0185882 | A1 | 9/2004 | Gecht et al. |
| 2004/0186811 | A1 | 9/2004 | Gullo et al. |
| 2004/0200902 | A1 | 10/2004 | Ishioroshi |
| 2004/0215523 | A1 | 10/2004 | Wulff et al. |
| 2004/0215581 | A1 | 10/2004 | Lord et al. |
| 2004/0215583 | A1 | 10/2004 | Elliott |
| 2004/0220935 | A1 | 11/2004 | McGraw et al. |
| 2004/0236938 | A1 | 11/2004 | Callaghan |
| 2004/0241424 | A1 | 12/2004 | Barbera-Guillem |
| 2004/0254898 | A1 | 12/2004 | Parker et al. |
| 2005/0033653 | A1 | 2/2005 | Eisenberg et al. |
| 2005/0065892 | A1 | 3/2005 | Ryan et al. |
| 2005/0065896 | A1 | 3/2005 | Kummer et al. |
| 2005/0065897 | A1 | 3/2005 | Ryan et al. |
| 2005/0071296 | A1 | 3/2005 | Lepkofker |
| 2005/0071297 | A1 | 3/2005 | Kara |
| 2005/0080751 | A1 | 4/2005 | Burningham |
| 2005/0082818 | A1 | 4/2005 | Mertens |
| 2005/0087605 | A1 | 4/2005 | Auslander et al. |
| 2005/0114276 | A1 | 5/2005 | Hunter et al. |
| 2005/0116047 | A1 | 6/2005 | Lu et al. |
| 2005/0119786 | A1 | 6/2005 | Kadaba |
| 2005/0137949 | A1 | 6/2005 | Rittman et al. |
| 2005/0171869 | A1 | 8/2005 | Minnocci |
| 2005/0192899 | A1 | 9/2005 | Reardon |
| 2005/0192911 | A1 | 9/2005 | Mattern |
| 2005/0195214 | A1 | 9/2005 | Reid et al. |
| 2005/0209913 | A1 | 9/2005 | Wied et al. |
| 2005/0237203 | A1 | 10/2005 | Burman et al. |
| 2005/0256811 | A1 | 11/2005 | Pagel et al. |
| 2005/0278263 | A1 | 12/2005 | Hollander et al. |
| 2005/0278266 | A1 | 12/2005 | Ogg et al. |
| 2006/0000648 | A1 | 1/2006 | Galtier |
| 2006/0020505 | A1 | 1/2006 | Whitehouse |
| 2006/0036556 | A1 | 2/2006 | Knispel |
| 2006/0116971 | A1 | 6/2006 | Beckstrom et al. |
| 2006/0118631 | A1 | 6/2006 | Lubow et al. |
| 2006/0122947 | A1 | 6/2006 | Poulin |
| 2006/0136347 | A1 | 6/2006 | Reichelsheimer et al. |
| 2006/0173796 | A1 | 8/2006 | Kara |
| 2006/0190418 | A1 | 8/2006 | Huberty et al. |
| 2006/0220298 | A1 | 10/2006 | Fairweather et al. |
| 2006/0238334 | A1 | 10/2006 | Mangan et al. |
| 2006/0259390 | A1 | 11/2006 | Rosenberger |
| 2006/0283943 | A1 | 12/2006 | Ostrowski et al. |
| 2006/0287096 | A1 | 12/2006 | O'Kelley, II et al. |
| 2006/0293907 | A1 | 12/2006 | Castineiras |
| 2007/0005518 | A1 | 1/2007 | Beckstrom et al. |
| 2007/0011995 | A1 | 1/2007 | Weaver et al. |
| 2007/0017985 | A1 | 1/2007 | Lapstun et al. |
| 2007/0033110 | A1 | 2/2007 | Philipp et al. |
| 2007/0073587 | A1 | 3/2007 | Walker et al. |
| 2007/0078795 | A1 | 4/2007 | Chatte |
| 2007/0080228 | A1 | 4/2007 | Knowles et al. |
| 2007/0100672 | A1 | 5/2007 | McBride et al. |
| 2007/0174215 | A1 | 7/2007 | Morel |
| 2007/0179853 | A1 | 8/2007 | Feige et al. |
| 2007/0185726 | A1 | 8/2007 | Stickler et al. |
| 2007/0198441 | A1 | 8/2007 | Kara |
| 2007/0253350 | A1 | 11/2007 | Tung et al. |
| 2007/0255664 | A1 | 11/2007 | Blumberg et al. |
| 2008/0046384 | A1 | 2/2008 | Braun et al. |
| 2009/0125561 | A1 | 5/2009 | Garcia |
| 2009/0164392 | A1 | 6/2009 | Raju et al. |
| 2009/0171861 | A1 | 7/2009 | Horree et al. |
| 2010/0298662 | A1 | 11/2010 | Yu et al. |
| 2010/0312627 | A1 | 12/2010 | Khechef et al. |
| 2011/0015935 | A1 | 1/2011 | Montgomery et al. |
| 2011/0022544 | A1 | 1/2011 | Kim et al. |
| 2011/0029429 | A1 | 2/2011 | Whitehouse |
| 2011/0071944 | A1 | 3/2011 | Heiden et al. |
| 2011/0145107 | A1 | 6/2011 | Greco |
| 2011/0225180 | A1 | 9/2011 | Liao et al. |
| 2012/0008766 | A1 | 1/2012 | Robertson et al. |
| 2012/0159603 | A1 | 6/2012 | Queck |
| 2012/0233252 | A1 | 9/2012 | Vats et al. |
| 2012/0240204 | A1 | 9/2012 | Bhatnagar et al. |

FOREIGN PATENT DOCUMENTS

| | | | |
|---|---|---|---|
| EP | 153816 | A2 | 9/1985 |
| EP | 0282359 | A2 | 9/1988 |
| EP | 0507562 | A2 | 10/1992 |
| EP | 0571259 | A1 | 11/1993 |
| EP | 0596706 | A1 | 5/1994 |
| EP | 0658861 | A1 | 6/1995 |
| EP | 0782111 | | 7/1997 |
| EP | 0900830 | A1 | 3/1999 |
| EP | 0927958 | A2 | 7/1999 |
| EP | 0927963 | A2 | 7/1999 |
| EP | 1096429 | A2 | 5/2001 |
| EP | 1525994 | A2 | 4/2005 |
| FR | 2580844 | A1 | 10/1986 |
| GB | 2246929 | A | 2/1992 |
| GB | 2251210 | A | 7/1992 |
| GB | 2271452 | A | 4/1994 |
| JP | 63147673 | | 6/1988 |
| JP | 04284558 | B2 | 10/1992 |
| JP | 05132049 | | 5/1993 |
| JP | 09-508220 | | 8/1997 |
| JP | 11249205 | | 9/1999 |
| JP | 2000-105845 | A | 4/2000 |
| JP | 2005215905 | A | 8/2005 |
| WO | WO-88/01818 | A1 | 3/1988 |
| WO | WO-94/27258 | A1 | 11/1994 |
| WO | WO-95/17732 | | 6/1995 |
| WO | WO-199519016 | A1 | 7/1995 |
| WO | WO-97/14085 | | 4/1997 |
| WO | WO-97/40472 | A1 | 10/1997 |
| WO | WO-98/14907 | A2 | 4/1998 |
| WO | WO-98/14909 | | 4/1998 |
| WO | WO-98/57302 | A1 | 12/1998 |
| WO | WO-98/57460 | A1 | 12/1998 |

(56) References Cited

FOREIGN PATENT DOCUMENTS

| | | | |
|---|---|---|---|
| WO | WO-02/063517 | A2 | 8/2002 |
| WO | WO-03/039051 | A2 | 5/2003 |
| WO | WO-03/083784 | A1 | 10/2003 |
| WO | WO-2005042645 | A2 | 5/2005 |
| WO | WO-2005060590 | A2 | 7/2005 |

OTHER PUBLICATIONS

U.S. Appl. No. 10/862,058, Pagel et al.
U.S. Appl. No. 11/509,309, J. P. Leon.
U.S. Appl. No. 11/616,546, Bussell et al.
U.S. Appl. No. 11/616,569, Tsuie et al.
U.S. Appl. No. 11/729,148, Leon et al.
U.S. Appl. No. 12/030,739, McBride et al.
U.S. Appl. No. 12/103,496, Bortnak et al.
U.S. Appl. No. 12/316,240, Leon.
U.S. Appl. No. 12/553,824, Bortnak et al.
Non-Final Office Action dated Aug. 3, 2009 for U.S. Appl. No. 11/353,690 to Kara, filed Feb. 14, 2006, and entitled "System and Method for Validating Postage," 19 pages.
Alexander, K.L., "U.S. Stamps Pay Tribute to Starry-Eyed Jurors," Final Edition, Calgary Herald, Caliary, Alberta, Canada, Sep. 14, 2007, 2 pages.
"Mobile Postage stamps via text message announced", http://telecoms.cytalk.com/2011/03/mobile-postage-stamps-via-text-messages-announced/, CY.Talk Telecoms News Blog, Mar. 14, 2011 in Telecoms, Texting, pp. 1-9.
Mobile Postage Stamps via Text Messages Announced, Phone Reviews, Mobile Phones, News, Mar. 11, 2011, pp. 1-3.
Ford, C., "Frequent Flyer Programs," Australian Accountant, 63,1, Feb. 1993, pp. 52-58, 7 pages.
"Domestic Mail Manual Section 604," United States Postal Service, Aug. 31, 2005, 45 pages.
Brown, B., "Internet Postage Services," PC Magazine, Jun. 6, 2000, p. 133, Ziff-Davis Publishing Company, 1 page.
"Zazzle® Offers Zazzle Custom Stamps™ for Business," May 17, 2006, https://www.zazzle.com/about/press/releases?pr=12624, 2 pages.
Porter, William, "Canadians Take to Vanity Stamps in Very Big Way," Denver Post, Jul. 9, 2000, 2 pages.
Derrick, J. "The Meter is Running," Office Systems, vol. 11 No. 9, Sep. 1994, 6 pages.
Computergram International, "U.S. Postal Service to Introduce PC Postage Plans Today," Aug. 9, 1999, No. 3720, 1 page.
Terrell, "Licking Stamps: A PC and a Printer Will End Trips to the Post Office," U.S. News & World Report, Sep. 28, 1998, vol. 125, No. 12, 4 pages.
"Miniature, Coin-Shaped Chip is Read or Written with a Touch," News Release, Dallas Semiconductor, Jul. 1991, 9 pages.
"Endicia Announces PictureItPostage™," Jun. 6, 2005, http://www.endicia.com/-/media/Files/About%20Us/Press%20Room/Endicia_pr05-06-06.ashx>, 2 pages.
Ralph, J. "What's Selling: From Bricks and Mortar to Bricks and Clicks," Playthings Magazine, Feb. 1, 2003, 4 pages.
Menezes, A.J. et al., "Handbook of Applied Cryptography," CRC Press LLC, 1997 (Excerpt—Cover pages and pp. 512-515), 22 pages.
"Information-Based Indicia Program (IBIP) Performance Criteria for Information-Based Indicia and Security Architecture for Closed IBI Postage Metering Systems (PCIBI-C)," Jan. 12, 1999, the United States Postal Service (USPS), 49 pages.
Stamps: Beyond Elvis, May 15, 1994, New York Times Archives, 2 pages.
Minnick, Robert, "Postage Imprinting Apparatus and Methods for Use With a Computer Printer", Apr. 27, 1995, 71 pages.
Office Action dated Mar. 13, 2007 for JP 515,253/97; with English language translation (4 pages).
Office Action issued for Japanese Patent Application No. 515,253/1997, dated Apr. 21,2009; 5 pages (with English language translation).
Appeal Decision dated Apr. 20, 2010 for U.S. Appl. No. 10/991,241 to Kara, filed Nov. 17, 2004, and entitled "System and Method for Generating Personalized Postage Indicia," 9 pages.
Examiner's Answer to Appeal Brief dated Feb. 19, 2009 for U.S. Appl. No. 10/991,241 to Kara, filed Nov. 17, 2004, and entitled "System and Method for Generating Personalized Postage Indicia," 14 pages.
Final Office Action dated Dec. 10, 2008 for U.S. Appl. No. 10/994,914 to McBride et al., filed Nov. 22, 2004, and entitled "Customized Computer-Based Value-Bearing Item Quality Assurance," 25 pages.
Final Office Action dated Dec. 4, 2009 for U.S. Appl. No. 11/644,458 to Leon, filed Dec. 20, 2006, and entitled "Systems and Methods for Creating and Providing Shape-Customized, Computer-Based, Value-Bearing Items," 17 pages.
Final Office Action dated Jan. 26, 2009 for U.S. Appl. No. 10/994,728 to Huebner et al., filed Nov. 22, 2004, and entitled "Printing of Computer-Based Value-Bearing Items," 13 pages.
Final Office Action dated Jan. 31, 2006 for U.S. Appl. No. 10/991,241 to Kara, filed Nov. 17, 2004, and entitled "System and Method for Generating Personalized Postage Indicia," 13 pages.
Final Office Action dated Jun. 23, 2009 for U.S. Appl. No. 11/114,964 to Clem et al., filed Apr. 25, 2005, and entitled "Quality Assurance of Image-Customization of Computer-Based Value-Bearing Items," 11 pages.
Final Office Action dated Jun. 30, 2010 for U.S. Appl. No. 11/114,964 to Clem et al., filed Apr. 25, 2005, and entitled "Quality Assurance of Image-Customization of Computer-Based Value-Bearing Items," 23 pages.
Final Office Action dated Mar. 15, 2010 for U.S. Appl. No. 10/994,914 to McBride et al., filed Nov. 22, 2004, and entitled "Customized Computer-Based Value-Bearing Item Quality Assurance," 31 pages.
Final Office Action dated Apr. 21, 2010 for U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 12 pages.
Final Office Action dated Mar. 16, 2010 for U.S. Appl. No. 10/994,728 to Huebner et al., filed Nov. 22, 2004, and entitled "Printing of Computer-Based Value-Bearing Items," 13 pages.
Final Office Action dated Mar. 4, 2009 for U.S. Appl. No. 10/994,698 to Leon et al., filed Nov. 22, 2004, and entitled "Image Customization of Computer-Based Value-Bearing Items," 12 pages.
Final Office Action dated May 11, 2010 for U.S. Appl. No. 10/994,698 to Leon et al., filed Nov. 22, 2004, and entitled "Image Customization of Computer-Based Value-Bearing Items," 18 pages.
Final Office Action dated Nov. 4, 2010 for U.S. Appl. No. 11/644,458 to Leon, filed Dec. 20, 2006, and entitled "Systems and Methods for Creating and Providing Shape-Customized, Computer-Based, Value-Bearing Items," 22 pages.
Interview Summary dated Sep. 2, 2010 for U.S. Appl. No. 11/644,458 to Leon, filed Dec. 20, 2006, and entitled "Systems and Methods for Creating and Providing Shape-Customized, Computer-Based, Value-Bearing Items," 4 pages.
Non-Final Office Action dated Apr. 16, 2009 for U.S. Appl. No. 11/644,458 to Leon, filed Dec. 20, 2006, and entitled "Systems and Methods for Creating and Providing Shape-Customized, Computer-Based, Value-Bearing Items," 15 pages.
Non-Final Office Action dated Apr. 17, 2008 for U.S. Appl. No. 10/994,914 to McBride et al., filed Nov. 22, 2004, and entitled "Customized Computer-Based Value-Bearing Item Quality Assurance," 19 pages.
Non-Final Office Action dated Aug. 11, 2009 for U.S. Appl. No. 11/435,453 to Clem., filed May 16, 2006, and entitled "Rolls of Image-Customized Value-Bearing Items and Systems and Methods for Providing Rolls of Image-Customized Value-Bearing Items," 9 pages.
Non-Final Office Action dated Aug. 19, 2008 for U.S. Appl. No. 10/994,698 to Leon et al., filed Nov. 22, 2004, and entitled "Image Customization of Computer-Based Value-Bearing Items," 16 pages.

(56) References Cited

OTHER PUBLICATIONS

Non-Final Office Action dated Aug. 19, 2009 for U.S. Appl. No. 10/994,728 to Huebner et al., filed Nov. 22, 2004, and entitled "Printing of Computer-Based Value-Bearing Items," 13 pages.
Non-Final Office Action dated Aug. 26, 2009 for U.S. Appl. No. 10/994,914 to McBride et al., filed Nov. 22, 2004, and entitled "Customized Computer-Based Value-Bearing Item Quality Assurance," 29 pages.
Non-Final Office Action dated Aug. 3, 2009 for U.S. Appl. No. 10/994,698 to Leon et al., filed Nov. 22, 2004, and entitled "Image Customization of Computer-Based Value-Bearing Items," 13 pages.
Non-Final Office Action dated Dec. 12, 2007 for U.S. Appl. No. 11/635,871 to McBride et al., filed Dec. 8, 2006, and entitled "Formatting Value-Bearing Item Indicia," 5 pages.
Non-Final Office Action dated Dec. 23, 2009 for U.S. Appl. No. 11/114, 964 to Clem et al., filed Apr. 25, 2005, and entitled "Quality Assurance of Image-Customization of Computer-Based Value-Bearing Items," 21 pages.
Non-Final Office Action dated Dec. 31, 2007 for U.S. Appl. No. 10/991,241 to Kara, filed Nov. 17, 2004, and entitled "System and Method for Generating Personalized Postage Indicia," 11 pages.
Non-Final Office Action dated Dec. 9, 2009 for U.S. Appl. No. 11/729,239 to Leon et al., filed Mar. 28, 2007, and entitled "Computer-Based Value-Bearing Item Customization Security," 6 pages.
Non-Final Office Action dated Jul. 12, 2007 for U.S. Appl. No. 10/991,241 to Kara, filed Nov. 17, 2004, and entitled "System and Method for Generating Personalized Postage Indicia," 11 pages.
Non-Final Office Action dated Jul. 19, 2005 for U.S. Appl. No. 10/991,241 to Kara, filed Nov. 17, 2004, and entitled "System and Method for Generating Personalized Postage Indicia," 9 pages.
Non-Final Office Action dated Jul. 21, 2010 for U.S. Appl. No. 10/994,914 to McBride et al., filed Nov. 22, 2004, and entitled "Customized Computer-Based Value-Bearing Item Quality Assurance," 33 pages.
Non-Final Office Action dated Jul. 7, 2008 for U.S. Appl. No. 10/991,241 to Kara, filed Nov. 17, 2004, and entitled "System and Method for Generating Personalized Postage Indicia," 12 pages.
Non-Final Office Action dated Feb. 23, 2011 for U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 8 pages.
Non-Final Office Action dated Jun. 19, 2007 for U.S. Appl. No. 11/635,871 to McBride et al., filed Dec. 8, 2006, and entitled "Formatting Value-Bearing Item Indicia," 5 pages.
Non-Final Office Action dated May 29, 2008 for U.S. Appl. No. 10/994,728 to Huebner et al., filed Nov. 22, 2004, and entitled "Printing of Computer-Based Value-Bearing Items," 11 pages.
Non-Final Office Action dated May 7, 2010 for U.S. Appl. No. 11/644,458 to Leon, filed Dec. 20, 2006, and entitled "Systems and Methods for Creating and Providing Shape-Customized, Computer-Based, Value-Bearing Items," 18 pages.
Non-Final Office Action dated Nov. 26, 2008 for U.S. Appl. No. 11/114,964 to Clem et al., filed Apr. 25, 2005, and entitled "Quality Assurance of Image-Customization of Computer-Based Value-Bearing Items," 9 pages.
Non-Final Office Action dated Oct. 31, 2006 for U.S. Appl. No. 10/991,241 to Kara, filed Nov. 17, 2004, and entitled "System and Method for Generating Personalized Postage Indicia," 11 pages.
Notice of Abandonment dated Jun. 30, 2010 for U.S. Appl. No. 10/991,241 to Kara, filed Nov. 17, 2004, and entitled "System and Method for Generating Personalized Postage Indicia," 2 pages.
Notice of Allowance dated Aug. 5, 2010 for U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 11 pages.
Notice of Allowance dated Dec. 2, 2010 for U.S. Appl. No. 10/994,698 to Leon et al., filed Nov. 22, 2004, and entitled "Image Customization of Computer-Based Value-Bearing Items," 5 pages.
Notice of Allowance dated Feb. 3, 2011 for U.S. Appl. No. 11/114,964 to Clem et al., filed Apr. 25, 2005, and entitled "Quality Assurance of Image-Customization of Computer-Based Value-Bearing Items," 7 pages.
Notice of Allowance dated Jan. 5, 2007 for U.S. Appl. No. 10/994,768 to Leon et al., filed Nov. 22, 2004, and entitled "Computer-Based Value-Bearing Item Customization Security," 7 pages.
Notice of Allowance dated Jul. 15, 2008 for U.S. Appl. No. 11/635,871 to McBride et al., filed Dec. 8, 2006, and entitled "Formatting Value-Bearing Item Indicia," 7 pages.
Notice of Allowance dated Jun. 24, 2010 for U.S. Appl. No. 11/729,239 to Leon et al., filed Mar. 28, 2007, and entitled "Computer-Based Value-Bearing Item Customization Security," 6 pages.
Notice of Allowance dated Nov. 17, 2008 for U.S. Appl. No. 11/635,871 to McBride et al., filed Dec. 8, 2006, and entitled "Formatting Value-Bearing Item Indicia," 7 pages.
Notice of Allowance dated Nov. 24, 2008 for U.S. Appl. No. 10/197,044 to Raju et al., filed Jul. 16, 2002, and entitled "Generic Value Bearing Item Labels," 7 pages.
U.S. Appl. No. 10/994,698 to Leon et al., filed Nov. 22, 2004, and entitled "Image Customization of Computer-Based Value-Bearing Items," 126 pages.
U.S. Appl. No. 10/994,728 to Huebner et al., filed Nov. 22, 2004, and entitled "Printing of Computer-Based Value-Bearing Items," 122 pages.
U.S. Appl. No. 10/994,914 to McBride et al., filed Nov. 22, 2004, and entitled "Customized Computer-Based Value-Bearing Item Quality Assurance," 131 pages.
U.S. Appl. No. 11/114,964 to Clem et al., filed Apr. 25, 2005, and entitled "Quality Assurance of Image-Customization of Computer-Based Value-Bearing Items," 122 pages.
U.S. Appl. No. 11/435,453 to Clem, filed May 16, 2006, and entitled "Rolls of Image-Customized Value-Bearing Items and Systems and Methods for Providing Rolls of Image-Customized Value-Bearing Items," 69 pages.
U.S. Appl. No. 11/644,458 to Leon, filed Dec. 20, 2006, and entitled "Systems and Methods for Creating and Providing Shape-Customized, Computer-Based, Value-Bearing Items," 77 pages.
U.S. Appl. No. 11/729,239 to Leon et al., filed Mar. 28, 2007 and entitled "Computer-Based Value-Bearing Item Customization Security," 131 pages.
U.S. Appl. No. 12/316,240 to Leon, filed Dec. 9, 2008, and entitled "Systems and Methods for Facilitating Replacement of Computer-Based Value-Bearing Items," 158 pages.
U.S. Appl. No. 12/500,970 to Clem, filed Jul. 10, 2009, and entitled "Automatic Guarantee Delivery Tracking and Reporting for United States Postal Service Postage Refunds for Paid Computer-Based Postage," 70 pages.
U.S. Appl. No. 12/943,519 to Clem, filed Nov. 10, 2010, and entitled "Rolls of Image-Customized Value-Bearing Items and Systems and Methods for Providing Rolls of Image-Customized Value-Bearing Items," 65 pages.
U.S. Appl. No. 13/038,029 to Leon et al, filed Mar. 1, 2011 and entitled "Image-Customization of Computer-Based Value-Bearing Items," 131 pages.
U.S. Appl. No. 13/081,356 to Leon et al, filed Apr. 6, 2011 and entitled "Computer-Based Value-Bearing Item Customization Security," 136 pages.
Unpublished U.S. Appl. No. 11/509,309 to Leon filed Aug. 24, 2006 and entitled "Invisible Fluorescent Ink Mark," 15 pages.
Unpublished U.S. Appl. No. 12/030,739 to McBride et al. filed Feb. 13, 2008 and entitled "Systems and Methods for Distributed Activation of Postage," 35 pages.
International Search Report attached to PCT Application WO/88/01818, dated Nov. 30, 1987, 2 pages.
International Search Report issued for Application PCT/US96/16366, dated Jun. 13, 1997, 9 pages.
Unpublished U.S. Appl. No. 11/323,463 to Leon et al., filed Dec. 30, 2005 and entitled "Systems and Methods for Single Pass Printing Postage Indicia," 23 pages.
Davies, Brad L. "Printing System for Preventing Injustice by Delivering Print Data from Postal Charge Meter to Printer," Jan. 2001, 1 page.

(56) References Cited

OTHER PUBLICATIONS

Feare, Tom, "Shipping System Saves $2 Million Yearly," Modern Materials Handling, Aug. 2000, 55, 9; pp. A6-A7.
Martorelli, Business Reply Mail, Winton M. Blount Postal History Symposium, Sep. 2011, 13 pages.
Avery, S., "With new postage meters buyers can stamp out costs," Purchasing, 132, 11, Jul. 17, 2003, pp. 98-99.

* cited by examiner

SYSTEMS AND METHODS FOR ACTIVATION OF POSTAGE INDICIA AT POINT OF SALE

CROSS-REFERENCE TO RELATED APPLICATIONS

The present application is a continuation of U.S. patent application Ser. No. 15/960,474 entitled "SYSTEMS AND METHODS FOR ACTIVATION OF POSTAGE INDICIA AT POINT OF SALE," filed Apr. 23, 2018, which is a continuation of U.S. patent application Ser. No. 12/103,496 entitled "SYSTEMS AND METHODS FOR ACTIVATION OF POSTAGE INDICIA AT POINT OF SALE," filed Apr. 15, 2008 and issued May 22, 2018 as U.S. Pat. No. 9,978,185, which is related to co-pending and commonly assigned U.S. patent application Ser. No. 10/862,058 entitled "VIRTUAL SECURITY DEVICE," filed Jun. 4, 2004, Ser. No. 10/991,241 entitled "SYSTEM AND METHOD FOR GENERATING POSTAGE INDICIA," filed Nov. 17, 2004, Ser. No. 11/713,533 entitled "SYSTEM AND METHOD FOR PRINTING MULTIPLE POSTAGE INDICIA," filed Mar. 2, 2007, Ser. No. 11/509,309 entitled "INVISIBLE FLUORESCENT INK MARK," filed Aug. 24, 2006, Ser. No. 11/729,148 entitled "COMPUTER-BASED VALUE-BEARING ITEM CUSTOMIZATION SECURITY," filed Mar. 27, 2007 and issued Jun. 7, 2011 as U.S. Pat. No. 7,957,709, Ser. No. 12/030,739 entitled "SYSTEMS AND METHODS FOR THE DISTRIBUTED ACTIVATION OF POSTAGE," filed Feb. 13, 2008, and Ser. No. 12/103,483, entitled "SYSTEMS AND METHODS FOR DISTRIBUTED PRINTING OF POSTAGE INDICIA," filed Apr. 15, 2008 and issued Jun. 21, 2011 as U.S. Pat. No. 7,963,437, the disclosures of which are hereby incorporated herein by reference in their entirety.

TECHNICAL FIELD

The present invention relates to postage indicia and, more particularly, to providing activation of postage indicia at a point of sale.

BACKGROUND OF THE INVENTION

The use of postage indicia in place of traditional postage stamps has become wide spread. For example, solutions for generating and printing valid postage indicia using a home or office processor-based system, such as a personal computer, have been provided by Stamps.com Inc., Los Angeles, Calif. (the assignee of the present application) for a number of years. The postage indicia generated by such processor-based systems has typically been an information based indicia (IBI), wherein a barcode (e.g., two-dimensional barcode) carries information useful for validating the indicia when placed in the mail stream.

Such solutions have facilitated ad-hoc generation and printing of postage indicia, such as to generate and print individual postage indicia for a particular mail item. For example, during or upon completion of a letter or other document in a word processing application, such as WORD available from Microsoft Corporation, Redmond Wash., a user may utilize a web interface provided by Stamps.com Inc. to generate and print valid postage indicia for use in posting that document. Information based indicia of such postage indicia may include information uniquely linking the postage indicia to the mail item (e.g., addressee information).

The foregoing solutions have additionally facilitated batch generating and printing of postage indicia, such as to generate and print plural postage indicia for later use with various mail items. For example, a user may utilize a web interface provided by Stamps.com Inc. to generate and print a sheet of "generic" postage indicia, perhaps using uniquely serialized stock, for use with mail items much like a more traditional sheet of stamps may be used. Such generic postage indicia is not linked to a particular mail item, thus the information based indicia thereof would not include information uniquely linking the postage indicia to the mail item. Such information based indicia may, however, include information identifying the user creating the postage indicia, the user's account used in creating the postage indicia, etc.

Although providing a very convenient solution for providing valid postage to individuals and businesses upon demand, 24 hours a day, 7 days a week, the foregoing solutions may not address every situation. For example, a user may not be comfortable with processor-based technology and thus be reluctant to utilize such systems to generate and print postage. A user, although regularly using such processor-based system, may have insufficient supplies on hand (e.g., label stock, printer ink/toner, etc.) to print postage indicia. Similarly, a user may be traveling and thus not have a processor-based system available for their use in generating and printing postage indicia. Accordingly, such a user may attempt to purchase traditional postage at a retail location or other point of sale (POS) (e.g., vending machine).

Typically, only a particular denomination of postage stamp (e.g., stamps valued for 1 oz. first class postage, which today is $0.41) is available at most points of sale, such as retail locations outside of a postal facility. Moreover, retail locations often do not carry a deep stock of postage, in order to avoid having appreciable monies tied up in an item usually provided for patron convenience and which runs a risk of becoming stale with a change in postal rates. Accordingly, if postage is available at all at a point of sale, it is often not available in an exact denomination desired by a user.

BRIEF SUMMARY OF THE INVENTION

The present invention is directed to systems and methods which provide for activation of postage indicia at a point of sale. For example, embodiments of the present invention facilitate the activation of postage indicia at various point of sale locations, such as retail locations, consumer kiosks, vending machines, etc. Embodiments implement techniques to avoid widespread availability of live (e.g., active or representing postage value) postage barcodes and/or prevent printing of fraudulent postage indicia. Postage indicia activated at a point of sale according to embodiments of the invention provides postage indicia acceptable by a postal authority for proof of payment for postal service.

In operation according to embodiments of the invention, unassigned (e.g., not yet activated or not yet representing postage value) tokens (e.g., IBI barcodes) suitable for later use as postage indicia are made available for purchase by users. Upon purchase, at a point of sale, such unassigned tokens are preferably activated as valid or "live" postage indicia. Thereafter, the postage indicia may be used to post mail items.

Such unassigned tokens may have a pre-established postage denomination associated therewith (e.g., $0.41) or may be denomination agnostic. A postage value for denomination agnostic tokens may be assigned upon activation as postage indicia, such as in accordance with an amount tendered for postage value at the point of sale. It should be appreciated, however, that even where unassigned tokens have a pre-established postage denomination associated therewith, the unassigned token itself has no value according to embodiments of the invention. That is, the pre-established postage denomination of embodiments establishes an amount of value that is to be afforded to a postage indicium resulting from activation of the unassigned token according to embodiments of the invention.

Postage indicia activated at a point of sale according to embodiments of the invention may comprise centrally printed unassigned tokens which are distributed to various points of sale for activation as postage indicia according to the present invention. For example, a manufacturer, such as a postage service provider (e.g., a PC postage vendor, an Internet postage vendor) or a postal authority (e.g., the United States Postal Service (USPS) or other postal service, etc.), may provide centralized printing of unassigned tokens on postage stock.

Postage indicia activated at a point of sale according to embodiments of the invention may comprise unassigned tokens which are printed at distributed locations, such as at the various points of sale. For example, a retail location, such as a discount store, department store, convenience store, drug store, etc., may periodically interact with a postage service provider or postal authority to print a supply of unassigned tokens on postage stock for sale by the retail location.

Unassigned tokens as may be printed on postage stock according to embodiments of the invention may comprise complete or partial tokens. For example, where unassigned tokens are provided in the form of IBI barcodes, a partial IBI barcode may be printed within each portion of the postage stock which is to later form a postage indicium. Such incomplete unassigned tokens are preferably completed at a later time, such as during point of sale processing, adding further security with respect to preventing fraudulent or unauthorized use of tokens used in creating valid postage indicia. However, even where the unassigned token printed on the postage stock is a complete token, its being unassigned provides security with respect to preventing fraudulent or unauthorized use of the token.

Accordingly, the postage stock, having unassigned token printed thereon, may be distributed to various point of sale locations, or otherwise made available at the point of sale locations, for use in creating valid postage indicia according to embodiments of the invention with little or no risk that the tokens thereon can be fraudulently used. For example, postage stock bearing unassigned tokens according to embodiments of the present invention may be placed on retail shelves for purchase at various retail locations without substantial risk that such unassigned tokens may be stolen because the unassigned tokens only have value upon activation according to embodiments of the invention. The postage stock bearing such unassigned tokens may be selected for purchase by an individual and postage indicia activated at the point of sale using a substantially traditional payment model (e.g., payment by a purchaser to a retail merchant by cash, check, credit card, debit card, etc.).

Postage stock bearing unassigned tokens, and thus postage indicia after activation according to embodiments of the invention, may comprise various forms of media. For example, unassigned tokens may be printed upon postage stock comprising sheets having a plurality of removable label portions to thereby provide a sheet of a plurality of postage indicia upon activation. Unassigned tokens may additionally or alternatively be printed upon postage stock comprising letter stock, envelope stock, flat stock, postcard stock, box stock, roll stock, tape stock, etc., so as to facilitate providing postage indicia on various media useful in different situations.

The foregoing postage stock preferably includes some form of unique or substantially unique (collectively referred to herein as unique) identification information (e.g., substantially unique identification information may be repeated at intervals sufficient to avoid confusion as to identification of particular postage stock), such as a serial number, digital signature, cryptographic code, etc. According to a preferred embodiment, the foregoing postage stock includes the identification information in a machine readable format, such as barcode, magnetic ink character recognition (MICR) code, radio frequency identification (RFID) tag, holographic code, etc., so as to facilitate automated scanning of the information, such as at a point of sale. Additionally or alternatively, one or more of the unassigned tokens may be used to provide identification of postage stock, such as where an ability to read or otherwise identify unassigned token(s) printed on the postage stock is available (e.g., where POS terminal equipment is compatible with IBI barcode technology).

The unassigned tokens on postage stock are preferably assigned at a point of sale, or other point after purchase by a user, to thereby become live postage. For example, equipment of a POS system, such as at a retail location or kiosk, may scan the postage stock unique identification (e.g., using a barcode scanner, a MICR reader, an RFID scanner, optical character recognition (OCR) system, etc.) to identify the particular postage stock, and thus the unassigned token, for assigning those tokens as live postage. The identification information, preferably accompanied by additional information (e.g., desired number of postage indicia, postage indicia amount, postage class, account for payment of postage value, etc.) may be provided to an entity for assigning or activating the tokens as live postage and/or other processing. For example, the foregoing information may be provided to the postage service provider which initially produced the unassigned tokens for activation of the tokens.

In operation according to embodiments of the invention, the identification information is used to assign or activate unassigned tokens, and thus the postage indicia generated therewith, to provide live postage indicia acceptable to a postal authority. For example, copies of the unassigned tokens, information included within the unassigned tokens, information identifying the unassigned tokens, etc. may be moved from an unassigned token database to an assigned token database to thereby activate the tokens, and thus the postage indicia created therewith, as live postage. Other information may additionally or alternatively be stored in association with activated tokens, such as user information (e.g., user identification, payment information, etc.), point of sale or activation information (e.g., retailer identification, activation location, etc.), and/or the like.

Activation of the postage indicia preferably includes payment to a postal authority (e.g., the USPS) for the appropriate postage value, such as through decrementing a descending register of a postage security device, debiting a prepaid account, incrementing a postpaid account, and/or the like. The foregoing payment for postage value may be provided directly from a user, indirectly from a user through an activation service provider (e.g., retailer), indirectly from a user through a postage service provider (e.g., Internet postage provider), directly from an activation service provider, indirectly from an activation service provider through a postage service provider, etc.

After the foregoing activation of the postage indicia, individual postage indicium may be utilized to post mail items. The token present on any or each such postage indicium may be utilized at one or more points in a mail processing stream to validate the postage indicium, to detect fraud or misuse of tokens, etc.

It should be appreciated that distribution of complete postage indicia would increases the risk of fraud or misuse of the postage indicia, such as through theft of a digital file which includes complete, live postage indicia being transferred. For example, a shop-lifter (i.e., thief) could remove postage stock from a retail location without payment for the postage value. However, because the postage stock bears only unassigned tokens before activation, such as upon payment at the point of sale, the theft of such postage stock does not result in the theft of postage value.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION OF THE INVENTION

Figure 1A:
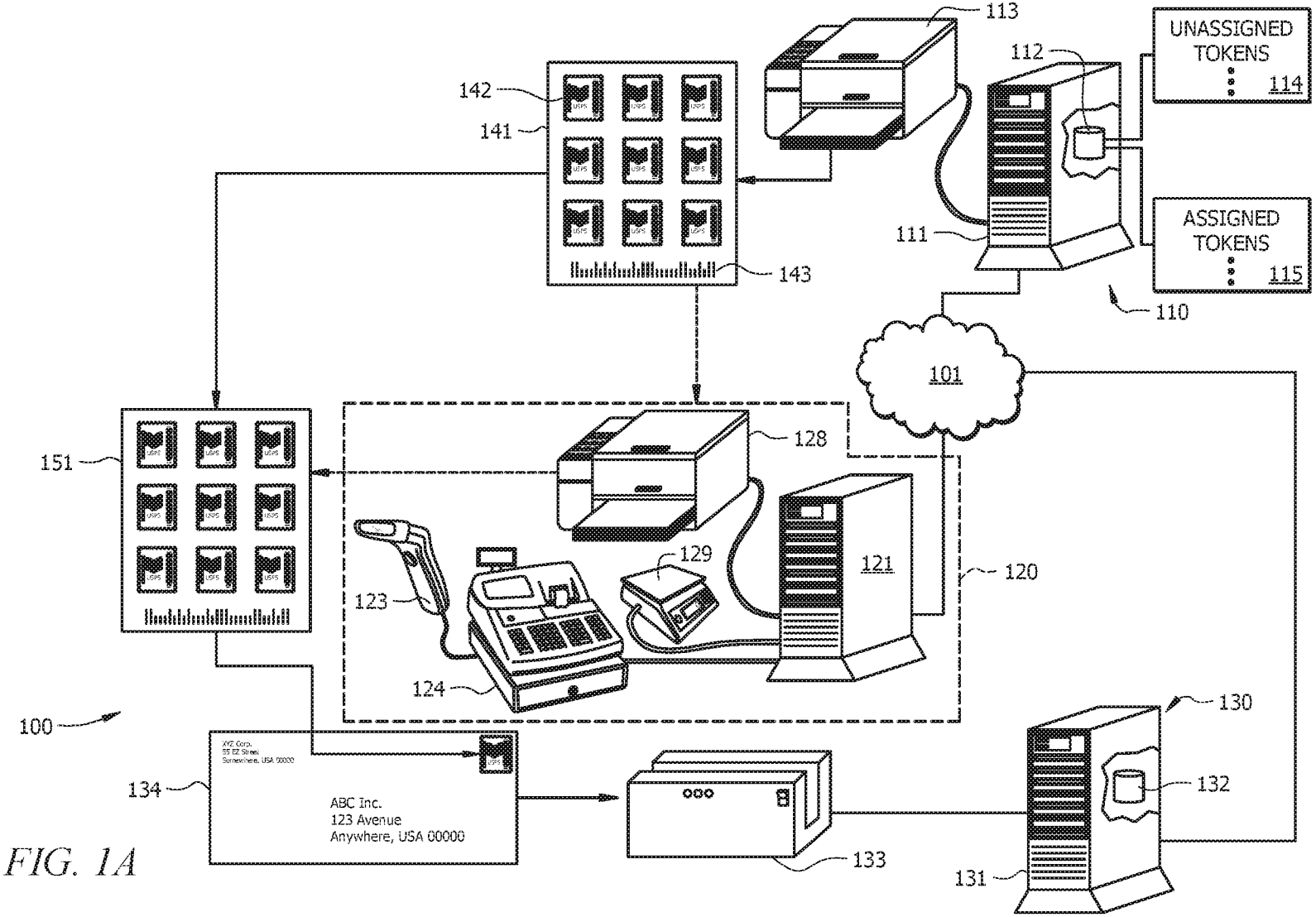
FIGS. 1A and 1B show systems adapted to provide activation of postage indicia at a point of sale according to an embodiment of the present invention.
Figure 1B:
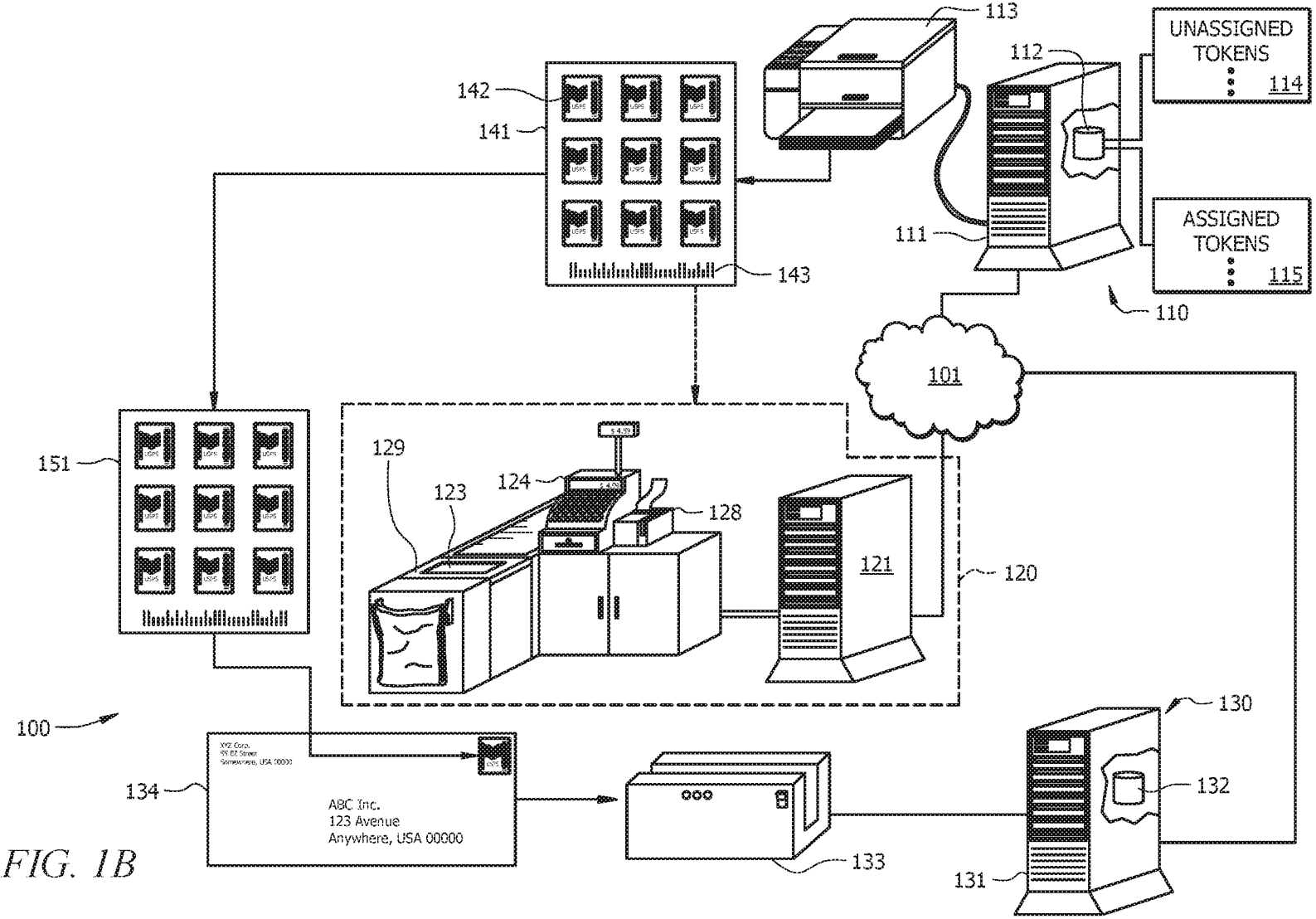

Directing attention to FIGS. 1A and 1B, systems adapted to provide activation of postage indicia at a point of sale according to embodiments of the invention are shown as system 100. System 100 of the illustrated embodiments comprises activation system 110, point of sale system 120, and validation system 130, in communication through network 101, cooperating to provide activation of postage indicia at a point of sale.

Network 101 of the illustrated embodiments provides information communication between activation system 110, point of sale system 120, and validation system 130. The foregoing systems may be disposed locally or remotely with respect to one another. For example, activation system 110 and validation system 130 may be disposed locally with respect to each other (e.g., at a postal system facility), whereas point of sale system 120 may be disposed remotely with respect to activation system 110 and validation system 130 (e.g., at a retail location or public space). Of course, activation system 110 and validation system 130 may be disposed remotely with respect to each other, if desired. Accordingly, network 101 of embodiments may comprise the Internet, an intranet, an extranet, a local area network (LAN), a metropolitan area network (MAN), a wide area network (WAN), the public switched telephone network (PSTN), a wireless network, a cable transmission system, a satellite communication network, and/or the like.

Activation system 110 preferably comprises a processor-based system, such as a computer having a central processing unit (CPU), memory (shown as including database 112), and appropriate input/output (I/O) devices and interfaces, operable under control of an instruction set defining operation as described herein. For example, activation system 110 may comprise server platform 111 having a processor from the PENTIUM family of processors available from Intel Corporation, Santa Clara, Calif. Activation system 110 of the illustrated embodiment provides generation, printing, and activation of tokens for use in generation and printing of postage indicia as described below. Accordingly, activation system 110 of the illustrated embodiments includes database 112 for storage of token identification and status (e.g., as may be provided in unassigned token database 114 and assigned token database 115) and printer 113 for printing tokens on postage stock, such as may comprise envelopes, labels, sheets of paper, etc.

Although shown as a single system for simplicity, activation system 110 of embodiments may be implemented as a plurality of platforms. For example, separate platforms may be used to generate and print unassigned tokens and/or to activate tokens. Printing of tokens separately from activating the postage indicia as postage indicia may be particularly useful in scenarios where envelope manufacturers or other stock manufacturers include tokens for postage indicia on various forms of envelopes and/or other stationary items at the time of manufacture.

Point of sale system 120 preferably comprises a processor-based system, such as computers having a CPU, memory, and appropriate I/O devices and interfaces, operable under control of instruction sets defining operation as described herein. For example, point of sale system 120 may comprise a computer platform 121 having a processor from the PENTIUM family of processors available from Intel Corporation, Santa Clara, Calif. Point of sale system 120 preferably provides communication of postage stock and/or token identification information to activation system 110 for activation of tokens for use as postage indicia according to the concepts of the present invention. Accordingly, the illustrated embodiments of point of sale system 120 includes scanner device 123 for scanning postage stock identification information and/or unassigned tokens, as will be discussed in further detail below. Of course, other forms of input of information regarding the forgoing information may be utilized according to embodiments of the invention, such as a keyboard of point of sale (POS) terminal 124. For example, scale 129 is provided for input of postal item weight, such as for use in rating postage in order to determine an appropriate or desired amount of postage value for activated postage indicia.

Although shown as separate components in the embodiment illustrated in FIG. 1A, it should be appreciated that point of sale system 120 may comprise different configurations than that shown. For example, scanner device 123 may be integrated into POS terminal 124 and/or POS terminal 124 may be integrated into computer platform 121. The embodiment illustrated in FIG. 5, for example, comprises an integrated POS terminal configuration such as may be found in a grocery store checkout isle. In the embodiment illustrated in FIG. 5, scanner 123 comprises a laser scanner disposed in the checkout conveyer path of the checkout isle, such as is common with universal price code (UPC) scanners used by grocery stores. Similarly, scale 129 comprises a flat bed scale integrated with scanner 123, such as is common with produce scales used by grocery stores. POS terminal 124 may interface with scanner 123 and scale 129 to obtain information therefrom as described above. POS terminal 120 further interfaces with printer 128, such as is common with receipt and check endorsing printers used by grocery stores.

Validation system 130 preferably comprises a processor-based system, such as a computer having a CPU, memory (shown as including database 132), and appropriate input/output (I/O) devices and interfaces, operable under control of an instruction set defining operation as described herein. For example, validation system 130 may comprise server platform 131 having a processor from the PENTIUM family of processors available from Intel Corporation, Santa Clara, Calif. Validation system 130 of the illustrated embodiments provides scanning and validation of postage indicia borne on mail pieces as described below. Accordingly, validation system 130 of the illustrated embodiments includes database 132 for storage of validation information (e.g., postage indicia identification and status) and mail piece scanner 133 for scanning and processing mail pieces.

It should be appreciated that configurations of validation system 130 other than that illustrated may be utilized according to embodiments of the invention. For example, mail piece scanner 133 may be coupled to activation system 110, such as through network 101, for performing validation as described herein without server platform 131, if desired.

Use of a validation system, such as validation system 130, is optional according to embodiments of the invention. However, to provide increased confidence as to the validity of postage indicia, and other information based indicia, embodiments of the invention implement a validation system. In order to reduce the volume of processing associated with such a validation system, embodiments of the invention may operate to validate a random or statistical sampling of indicia, rather than each indicia introduced into the mail stream.

Figure 2:
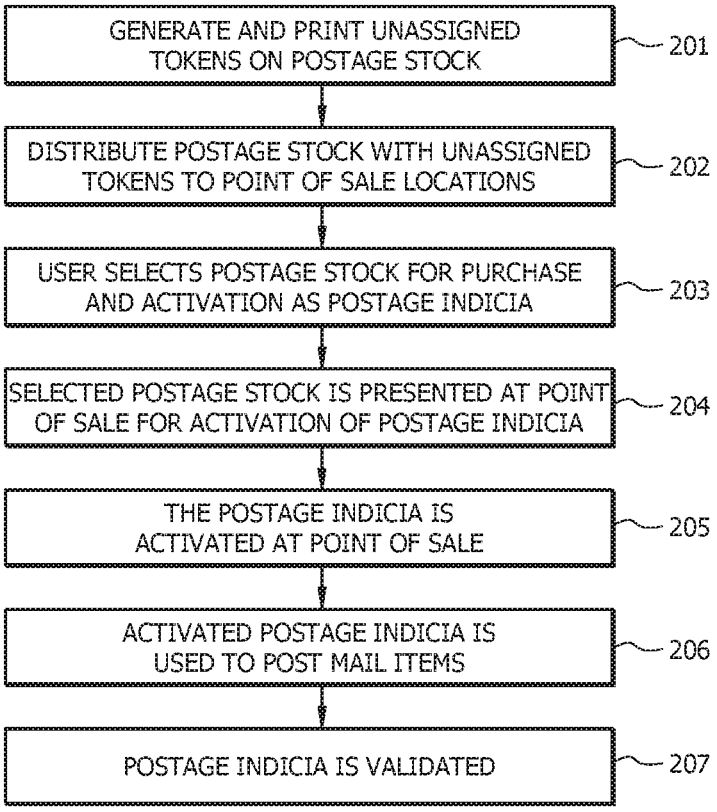
FIG. 2 shows a flow diagram of operation to provide activation of postage indicia according to an embodiment of the present invention.

Operation of system 100 to activate postage indicia at a point of sale according to an embodiment of the present invention is represented in the flow diagram of FIG. 2. According to the illustrated embodiment, a manufacturer (e.g., a postage service provider such as Stamps.com, Inc.) generates unassigned or generic tokens that may be used as postage indicia at block 201. The tokens are printed on postage stock for later use in activation as valid postage indicia. For example, activation system 110 generates a plurality of tokens and controls printer 113 to print tokens upon various postage stock, such as envelopes, labels, sheets of paper, etc. Each such token is preferably unique or substantially unique so as to facilitate accurate validation, accounting, and/or auditing with respect to the activation and use thereof.

Printer 113 of the illustrated embodiment is shown printing machine readable tokens 142 on postage stock 141. Although label stock having a plurality of postage indicia transfer areas thereon is illustrated as postage stock 141, embodiments of the invention may utilize different forms of stock. For example, envelope stock, plain paper stock, letterhead stock, label stock, large envelope (flat) stock, and combinations thereof may be utilized according to embodiments of the invention.

Figure 3A:
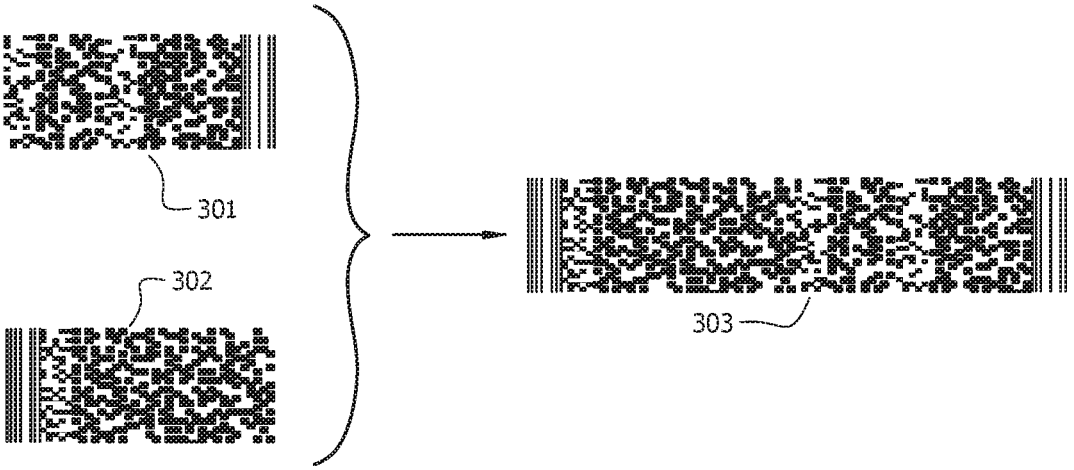
FIGS. 3A and 3B show various embodiments of partial tokens as may be completed according to embodiments of the invention.

Embodiments of the invention may operate to print a complete token or a partial token on postage stock 141. For example, to provide added security with respect to misuse of the tokens, embodiments may operate to print a fractional token (e.g., partial token 301 of FIG. 3A) which is missing a portion thereof, such as a right, left, top, or bottom portion thereof (e.g., completion partial token 302). Such an embodiment may provide a token which is visibly incomplete, thereby rending the token obviously unacceptable for use as postage indicia in its present state. Embodiments may additionally or alternatively operate to print apparently complete tokens (e.g., partial token 311), but which are missing one or more pieces of information, such as missing various "dots" of a two dimensional barcode (e.g., completion partial token 312), thereby rendering the token unacceptable for use as postage indicia, although perhaps not visibly so. The missing portions of such tokens are preferably stored, such as within database 112 (e.g., within unassigned tokens database 114) for later adding to the tokens. For example, when such a partial token is assigned or activated, the missing portion of the token may be provided for completing the token. The foregoing partial tokens may be completed by printing the completion partial token (e.g., completion partial tokens 302 and 312) at a later time, such as when activated at a point of sale (e.g., using printer 128 of point of sale system 120), to thereby provide complete tokens (e.g., complete tokens 303 and 313).

Machine readable tokens 142 may comprise a bar code such as a PDF417 two dimensional barcode, a data matrix two dimensional barcode, a code 128 one dimensional barcode, a POSTNET (bar and half bar encoding) one dimensional barcode, and/or the like. Additional or alternative forms of machine readable symbology which may utilized according to embodiments of the invention include universal product code (UPC), code 93, dotcode, magnetic ink character recognition (MICR), etc. Tokens may additionally or alternatively be provided in other forms, such as human readable characters (e.g., letters, numerals, and/or symbols), graphic images, and/or the like. Machine readable embodiments of tokens 142 are provided in a form consistent with the information based indicia (MI) acceptable to postal authorities, such as the United States Postal Service. Tokens 142 need not include all the information of a full IBI, such as where tokens 142 comprise a "light" IBI implementation as shown in the above referenced patent application entitled "Computer-Based Value-Bearing Item Customization Security."

A robust barcode such as the aforementioned PDF417 and data matrix barcodes are preferred according to embodiments of the invention in order to encode a relatively large amount of information therein, to provide data redundancy for error correction, to provide data security, etc. A one dimensional barcode such as the aforementioned POSTNET and code 128 barcodes are preferred according to some embodiments of the invention in order to provide encoded data in a form which is readily scanned using relatively inexpensive and/or which is widely available. Of course, multiple machine readable portions may be included as part of a machine readable token, such as to include a robust two dimensional barcode and a widely readable one dimensional barcode, to accommodate a large variety of use scenarios if desired.

Tokens 142 may be printed using media which is visible in natural light, which is invisible in natural light, or a combination thereof (e.g., partially visible in natural light and partially invisible in natural light) according to embodiments of the invention. For example, tokens 142 provided according to embodiments of the invention may be printed using traditional inks, toners, thermally activated components, etc. to provide an indicia which is visible in natural light. Additionally or alternatively, tokens 142 of embodiments of the invention may be printed using an ink which is invisible in natural light. Printed matter using such ink may be viewed using light of an appropriate wavelength, such as light in the ultraviolet spectrum. Additional detail with respect to indicia which is invisible in natural light is provided in the above referenced patent application entitled "Invisible Fluorescent Ink Mark."

Visibility of indicia which is initially invisible may be transient (e.g., visible only when light of the appropriate wavelength is present) or more permanent (e.g., chemically or molecularly changing to remain visible after light of the appropriate wavelength to "develop" the image is removed). Detail with respect to the use of bi-stable indicia as may be used as the tokens herein is provided in the above referenced patent application entitled "Systems and Methods for the Distributed Activation of Postage." The use of such bi-stable tokens, rendered visible at activation, may provide additional security and fraud prevention with respect to postage indicia of the present invention.

Postage stock 141 preferably includes a code or other identifying information useful in uniquely identifying the postage stock and/or the tokens printed thereon. For example, code 143 included on postage stock 141 may include a serial or sequence number, identification information, digital signature, cryptographic key, and/or the like useful in uniquely identifying postage stock 141 and/or tokens 142 printed thereon. Activation system 110 preferably records such identification information in database 112, such as part of the data of unassigned tokens database 114, for use in activating the postage indicia.

Additionally or alternatively, tokens 142 may include a code or other identifying information useful in uniquely identifying the tokens. For example, codes included in the tokens may include serial or sequence numbers, identification information, digital signatures, cryptographic keys, and/or the like useful in uniquely identifying the tokens and/or the postage indicia created therewith. Activation system 110 preferably records such identification information in database 112, such as part of the data of unassigned tokens database 114, for use in activating and/or verifying the postage indicia.

According to embodiments of the invention information, such as the activation status of tokens, is stored in database 112, such as part of the data of unassigned tokens database 114. For example, when tokens 142 are generated, activation system 110 may store a unique code identifying each generated token in database 112 along with a status identifier indicating the tokens are "unactivated" or "unassigned." As discussed below, the status identifier may be updated upon activation of the tokens when postage indicia has been purchased and activated to indicate the indicia are "activated." Such status identifiers may be useful with respect to validation of the indicia, as discussed further below. Additional or alternative information which may be stored in association with tokens may include identification of an entity or account for which the tokens were generated (e.g., a business requesting the tokens for their inventory or their use in mailing postal items), an entity generating the tokens (e.g., a service provider generating the tokens), identification of a system used to generate the tokens, cryptographic keys used for encrypting/decrypting information in the tokens, digital signatures used to authenticate the tokens, information regarding geographic areas mail items bearing indicia using the tokens may be introduced into a mail processing stream and/or geographic areas mail bearing indicia using the tokens may be delivered to, particular services and/or levels of service indicia bearing the indicia may be used for, and/or the like. Such additional information may be used in an audit trail with respect to any particular token or indicium created therewith, used to detect fraud or abuse of tokens and indicia crated therewith, used for accounting purposes, used to restrict or manage the use of tokens or indicia created therewith, etc.

Although embodiments are described above with respect to providing information to identify an entity or account for which tokens and/or indicia created therefrom were generated, tokens and indicia provided according to embodiments of the invention, both before activation and thereafter, may be anonymous (e.g., a user of the indicia is not identified by the indicia, as with a traditional postage stamp). Likewise, although embodiments are described above with respect to providing tokens and indicia which are geographically restricted (e.g., having a limitation with respect to a source and/or destination address associated with the use of the postage indicia), it should be appreciated that tokens and indicia provided according to embodiments of the invention may be geographically ambivalent (e.g., having no limitation with respect to a source or destination address associated with use of the postage indicia).

Tokens of embodiments of the invention may be printed alone or in combination with various images, information, characters, symbols, ornamental images, and/or marks (collectively referred to as marks). For example, tokens may be printed alone, with one or more marks used to facilitate processing of indicia (e.g., a facing identification mark (FIM)), with human readable information, with one or more indicator marks, and/or the like. Such marks may be used in preparing mail items, processing mail items, for aesthetic or other purposes, etc.

Moreover, the tokens used according to embodiments may be provided in forms other than pre-printed embodiments. For example, tokens utilized according to embodiments of the invention may comprise radio frequency identification (RFID) tags embedded in or affixed to postage stock 141, if desired.

At block 202 of FIG. 2, postage stock 141 of the illustrated embodiment, having tokens 142 thereon, is provided to a number of point of sale locations for use in activating postage indicia at a point of sale. For example, postage stock 141 may be provided to a retail merchant, a kiosk service provider, a business operator, etc. associated with point of sale system 120, preferably as part of a plurality of postage stock, for later use in activation as postage indicia upon purchase by a patron. Such an operator may thus offer postage indicia to the public without investing appreciable monies in postage value, without risk of theft of postage value, without risk of postage rate changes rending their stock stale, and/or the like.

A user, such as a retail postal customer, selects postage stock for purchase and activation as postage indicia at block 203. For example, the user may select postage stock from a retail shelf or within a bin of a vending machine. Such postage stock may comprise a particular stock suitable for a particular use, such as a sheet of labels to provide a plurality of postage indicia for use in posting multiple mail items, a box of envelopes to provide both a plurality of indicia and a corresponding plurality of mail item containers for use in posting multiple mail items, a single "flat" (e.g., bubble pack envelope) to provide postage indicia and a container for mailing a large item, etc. Additionally or alternatively, the postage stock may comprise unassigned tokens suitable for a particular use, such as unassigned tokens having a desired pre-established postage denomination associated therewith (e.g., $0.41) suitable for a particular mail item, unassigned tokens which are denomination agnostic to facilitate activation of postage indicia having one or more desired postage value(s), etc. The postage stock may further comprise desired ornamental images, such as a national flag to commemorate a national holiday, a religious icon to celebrate a religious holiday, a matrimonial icon to celebrate a wedding or anniversary, etc.

At block 204, the selected postage stock is presented at a point of sale for activation of the unassigned token(s) as valid postage indicia. For example, having selected desired postage stock, the user is thus ready to activate the indicia for use as postage indicia. Scanner 123 may be utilized to scan code 143 included on postage stock 141 (and thus included on selected postage indicia stock 151) and/or one or more of tokens 142 for identification of the token(s) to activate as postage indicia. This information may be provided to activation system 110 for identification of the appropriate unassigned tokens, such as within unassigned tokens database 114, and activation of those tokens as valid postage indicia. Activation of the tokens may comprise moving data associated with particular tokens from unassigned tokens database 114 to assigned tokens database 115 and/or to database 132 of validation system 130.

The user may provide information in addition to selection of desired postage stock according to embodiments of the invention. Some or all of this additional information may be provided to activation system 110, point of sale system 120, and/or validation system 130. The user may, for example, select amounts of postage for the desired postage indicia, a class of mail, an account for payment of postage services and/or postage value, etc. Scale 129 may be utilized by a user to obtain a weight of one or more mail items for determining an amount of postage for the desired personalized postage indicia. For example, a user may present a postal item (e.g., letter or parcel) at a point of sale, such as at the checkout isle illustrated in FIG. 5. The postal item may be weighed by scale 129 and the selected postage stock scanned by scanner 123. Rating information may determine an appropriate postage value and operation as described herein provide activation of the unassigned token(s) as valid postage indicia having appropriate postage value. Distributed printing system 120 may comprise rating tables, or may interface with another system such as activation system 110 or validation system 130 having rating tables, for determining an amount of postage.

The unassigned tokens on the selected postage stock are activated as valid postage indicia at the point of sale at block 205. Activation system 110 preferably operates to change the status of tokens 142 from "unactivated" to "activated." For example, activation system 110 may locate the unique code or other information provided by point of sale system 120 in database 112 and change status information of tokens associated therewith, such as by changing a status indicator stored in association with the unique code, by moving the unique code from an "unactivated" portion of the database to an "activated" portion of the database, and/or the like. Such a change in status according to embodiments of the invention results in the postage indicia comprising the tokens becoming a valid postage indicia or a value bearing indicia.

As an example of the foregoing operation at block 205, the postage stock, having unassigned token printed thereon, may have been distributed to various point of sale locations in the form of retail outlets (e.g., pharmacies, department stores, office supply stores, discount retailers, photocopy print shops, grocery stores, etc.) for use in activating postage indicia at the point of sale. The postage stock may be purchased at such retail locations using a substantially traditional payment model (e.g., payment by a purchaser to a retail merchant by cash, check, credit card, debit card, etc.). For example, payments may be made from a user to a clerk at a retail location. Thereafter, an amount sufficient to pay for activated postage indicia can be transferred from the retail location to a postage service provider. This postage service provider may prepay or post-pay a postal authority (e.g., the USPS). Once a postage service provider determines the amount of postage value associated with postage indicia being activated, the postage service provider can update ascending and descending registers of a postage security device for appropriate accounting to the postal authority. Other payment models may additionally or alternatively be implemented according to embodiments of the invention.

Equipment of a POS system of the retail outlet may scan the postage stock unique identification (e.g., using a barcode scanner, a MICR reader, an RFID scanner, optical character recognition (OCR) system, etc.) to identify the particular postage stock, and thus the unassigned token, for assigning those tokens as live postage. This identification information, preferably accompanied by additional information (e.g., desired number of postage indicia, postage indicia amount, identification of image(s) included as postage indicia, postage class, account for payment of postage value, etc.) may be provided to an entity for assigning or activating the tokens as live postage and/or other processing, such as a postage service provider which initially produced the unassigned tokens for activation of the tokens. The identification information is used to assign or activate unassigned tokens, and thus the postage indicia generated therewith, to provide live postage indicia acceptable to a postal authority. Information identifying the now assigned tokens may be stored in a database to thereby activate the tokens. Other information may additionally or alternatively be stored in association with activated tokens, such as user information (e.g., user identification, payment information, etc.), point of sale or activation information (e.g., retailer identification, activation location, etc.), and/or the like.

Embodiments of activation system 110 preferably operate to facilitate accounting for and/or validating postage indicia. For example, activation system 110 may provide access to, or information from, database 112 to validation system 130 for use in validating postage indicia which have been introduced into the mail processing stream. The foregoing information may, according to embodiments, include information in addition to information identifying activated tokens. For example, the foregoing user information, such as may include user identification, information regarding a credit card or other account used to purchase the indicia and/or postage value, etc., may be provided to validation system 130 for use in fraud detection, providing an audit trail, etc. Additionally or alternatively, activation system 110 may communicate the fact that the indicia has been activated and/or other information, such as a value of the activated indicia, to point of sale system 120 and/or validation system 130 for use thereby.

Embodiments of activation system 110 operate to do more than change a status of a database record associated with tokens 142. For example, embodiments of the invention may utilize information provided with the aforementioned unique code, such as postal item weight, postal class, origination location information, destination information, and/or special handling instructions, in order to determine a postal rate, to provide statistical reporting, etc. Moreover, as discussed below, activation system 110 may additionally or alternatively operate to debit an account (or otherwise account for postage value) for the appropriate postal value, such as using the aforementioned determined rate or the desired postage amount transmitted with the unique code. Embodiments of the invention may collect value or fees in addition to a postage amount, such as to collect a surcharge for the point of sale activation service described herein. Additional functions, such as dispatching a courier to retrieve mail items, scheduling postal processing resources, providing reports, etc. may be performed by or in response to activation system 110 activating indicia.

Various forms of scanners may be utilized as scanner 123 of embodiments of the invention. For example, traditional optical scanner configurations, such as may comprise flat bed scanners, sheet fed scanners, handheld scanners, camera based scanners, or the like may be used with respect to indicia which is visible in natural light. Where tokens are used which are not visible in natural light or which are configured to be bi-stable, scanners used according to the present invention may be adapted for use therewith, such as by substituting or adding an illumination lamp operable to radiate a desired wavelength of light (e.g., ultraviolet, infrared, etc.). However, lamps used with respect to many commonly available scanners are broad-spectrum enough to cause many ultraviolet and other inks to fluoresce, thereby making it possible in many circumstances to use more traditional optical scanner configurations even with respect to specialized indicia configurations. Scanners implemented according to embodiments of the invention may additionally or alternatively employ technology other than optical scanner technology. For example, radio frequency (RF) scanner technology may be utilized with respect to identification codes and/or tokens borne in RFID tags.

Although embodiments are described above with reference to scanner 123 operating to scan postage stock code 143 and/or tokens 142, it should be appreciated that the use of such a scanner may be omitted according to embodiments of the invention. For example, where postage stock code 143 and/or tokens 142 comprises human readable information providing the aforementioned unique code or other suitable information, whether in combination with machine readable symbology or alone, a user may manually input the information into point of sale system 120, such as through POS terminal 124.

Activation of postage indicia of embodiments of the invention is provided at a point of sale, such as using POS terminal 124 of the illustrated embodiment. Accordingly, payment for the postage indicia generation and/or the postage value associated therewith is preferably made at the time of activation. For example, a user may tender an amount to pay for the postage indicia service and for postage value represented by the activated postage indicia. Such payment may be through an account of the user. Alternatively, the user may tender payment to an operator of point of sale system 120 at the point of sale, and an account of the owner of point of sale system 120 may be accessed for payment of postage value.

The foregoing payment for postage value may be provided directly from a user, indirectly from a user through an activation service provider (e.g., retailer), indirectly from a user through a postage service provider (e.g., Internet postage provider), directly from an activation service provider, indirectly from an activation service provider through a postage service provider, etc. Such accounting for such postage value payment may be made through incrementing an ascending register and decrementing a descending register, as is typical of a postage meter operation, or through a payment transaction more traditionally used outside of postage metering applications (e.g., without the use of secure ascending and descending registers). For example, prepaid accounts, postpaid accounts, electronic funds transfer, electronic commerce, and/or the like may be used according to embodiments of the invention. However, according to a preferred embodiment, a postage service provider operating activation system 110 will not pay a postal authority, such as the USPS, postage value for a token unless and until that token is included in postage indicia and activated. Detail with respect to accounting for postage value as may be utilized according to embodiments of the invention is shown in the above referenced patent application entitled "Virtual Security Device."

Scanner 123, or other apparatus of point of sale system 120, may additionally or alternatively operate to provide indication that tokens 142, and thus the postage indicia, have been activated. For example, where one or more bi-stable marks are included in association with tokens 142, scanner device 123 may operate to "develop" the mark (or an appropriate one of a plurality of marks) through exposure to a particular wavelength of light, an appropriate amount of heat, an appropriate frequency of radio frequency energy, an appropriate chemical, a suitable magnetic field, etc., upon activation of the indicium. Detail with respect to developing marks to show activation is provided in the above referenced patent application entitled "Systems and Methods for the Distributed Activation of Postage." The foregoing bi-stable marks need not be utilized to provide the foregoing information or other information on the mail items at the time of activation according to embodiments of the invention. For example, a mark printed by POS terminal 124, or other apparatus of point of sale system 120 (e.g., printer 128), may print symbols or information indicating activation of the postage indicia.

Figure 3B:
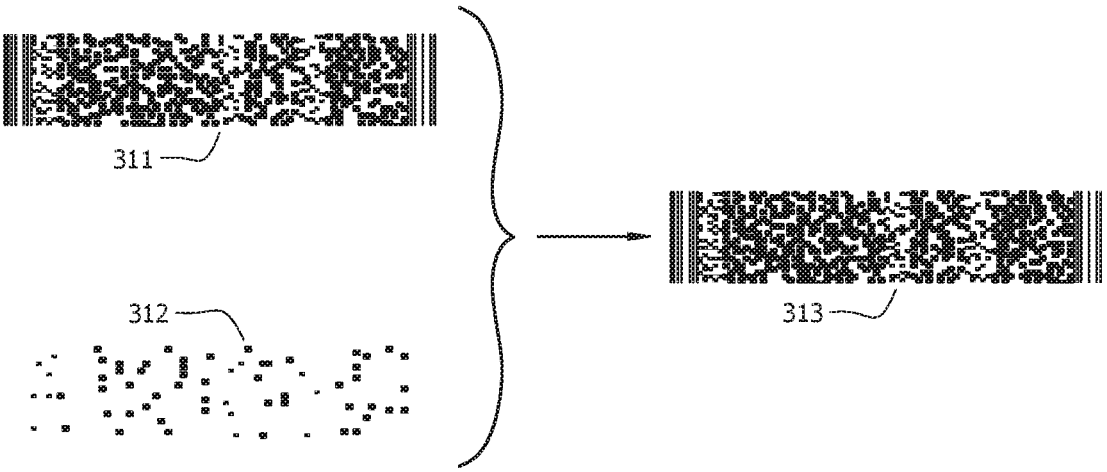
Figure 4:
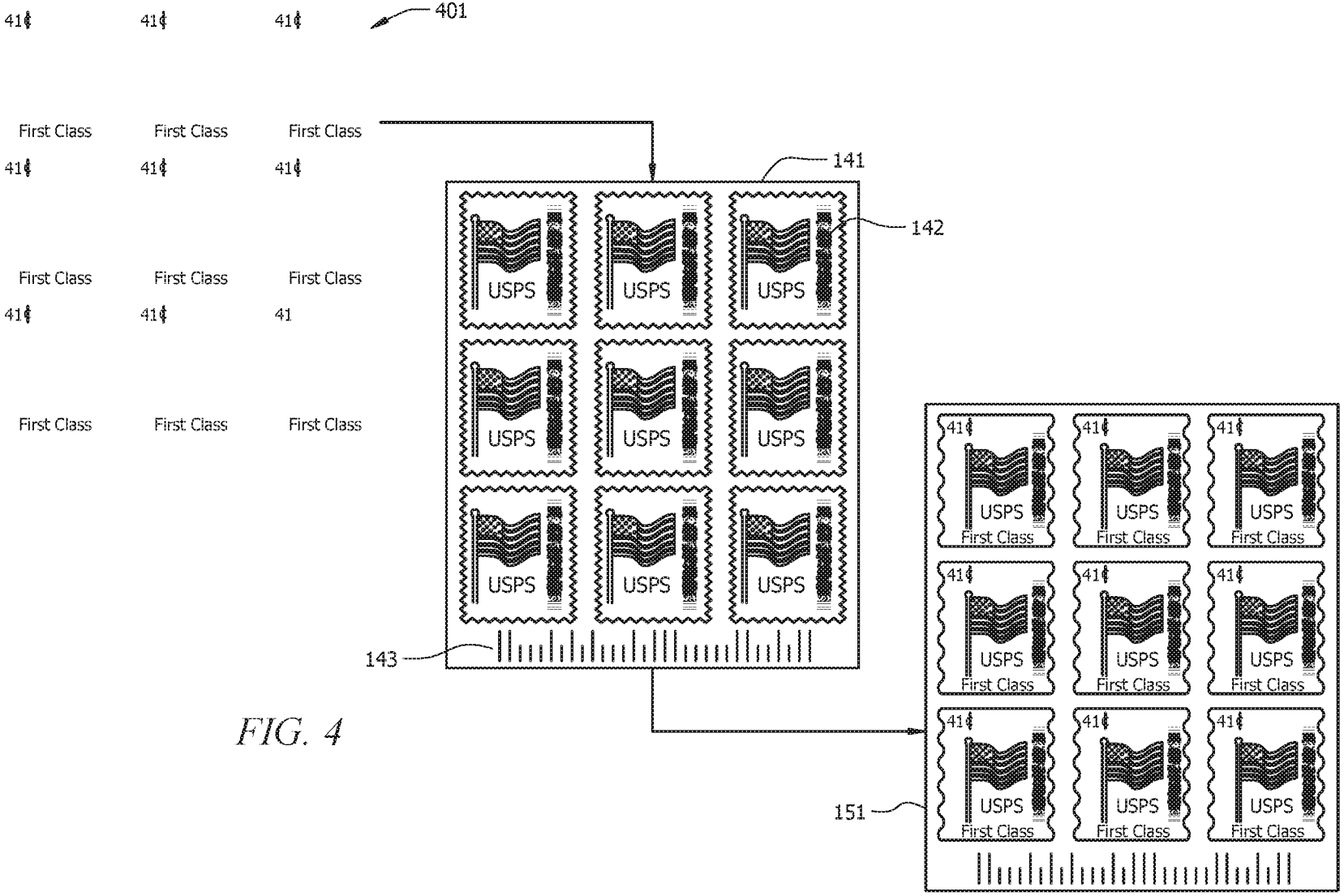
FIG. 4 shows information assembled in to an appropriate format for printing as postage indicia according to an embodiment of the invention.

Information may be added to the postage stock, and/or unassigned tokens thereon, at the point of sale according to embodiments of the invention. For example, an amount of the postage value, postal class, etc. may be printed on the postage stock (as shown in FIG. 4) at the point of sale. For example, where unassigned tokens are denomination agnostic, a postage value consistent with that selected by the user may be printed upon postage stock 141 by printer 128 at the point of sale. Likewise, where fractional tokens are provided on postage stock 141 (e.g., partial token 301 of FIG. 3A or partial token 311 of FIG. 3B), the missing portions of such tokens may be provided by activation system 110 for printing by printer 128 at the point of sale, thereby providing complete tokens (e.g., complete token 303 of FIG. 3A and complete token 313 of FIG. 3B).

The foregoing information to be added to the postage stock is preferably assembled in an appropriate format and/or including appropriate information added thereto and provided in an electronic file (e.g., file 401 of FIG. 4) for transmission to a point of sale location. It should be appreciated that security is not really an issue with respect to communication of a file containing the foregoing information because the file only contains information (and perhaps partial tokens) and does not contain any active or complete postage barcodes or similar indicia. Therefore, if the file is intercepted or stolen the intercepted or stolen information is not valuable. With the lower security requirements around protecting such a file, the file may be transmitted across the public Internet with minimal, if any, security using FTP, HTTP, etc. Additionally, the file may be printed without a local client application at the point of sale location (e.g., using a pure web browser application or other application). However, security techniques, such as encryption of the file for transmission between activation system 110 and point of sale system 120, may be implemented if desired.

According to embodiments of the invention, the postage indicia of postage stock 151 remains not active (i.e., tokens 142 remain unassigned or inactivated) until completion of the point of sale transaction. Thus, if an error occurs during printing (but before tokens 142 are activated), the foregoing file can simply be printed again immediately on new postage stock. The misprinted item produced does not need to be saved or returned (perhaps just destroyed) as it is not valid postage.

At block 206 activated postage indicia is utilized to post mail items. For example, a postage indicia may be removed from postage indicia stock 151 and applied to mail item 134, and mail item 134 may be introduced into the mail stream.

Postage indicia, or a statistical sampling thereof, is preferably validated (e.g., before mail processing, during mail processing, and/or after mail processing) at block 207. For example, mail piece scanner 133 of validation system 130 may obtain information from the postage indicia for use with information stored in database 112 and/or 132 (e.g., comparison of the scanned information to the stored information) in order to validate the indicia. Mail piece scanner 133 may thus comprise traditional optical scanner configurations, such as flat bed scanners, sheet fed scanners, handheld scanners, camera based scanners, or the like when indicia which is visible in natural light are used. As with scanner device 123 discussed above, where tokens are used in the postage indicia which is not visible in natural light, mail piece scanners used according to the present invention may be adapted for use therewith, such as by substituting or adding an illumination lamp operable to radiate a desired wavelength of light (e.g., ultraviolet, infrared, etc.). Likewise, mail piece scanners implemented according to embodiments of the invention may additionally or alternatively employ technology other than optical scanner technology, such as RF scanner technology where RFID tags are used.

According to embodiments of the invention, as a mail item is processed (e.g., at a mail service provider's mail processing station) after the mail item has been introduced into the mail stream, the mail piece is passed through mail piece scanner 133 for scanning tokens 142 to obtain information such as the aforementioned unique code. Validation system 130 may compare this information to information in database 132 and/or database 112 to determine if the postage indicium is a valid postage indicium. If the indicium is valid (e.g., is activated), validation system 130 may allow the mail item to pass for further processing (e.g., processing for delivery to an appropriate destination address). However, if the postage indicium is not valid (e.g., the token therein is unactivated), validation system 130 may prevent further processing (e.g., direct the mail item to a "return to sender" bin) and/or may provide additional processing, as described in further detail below. Various audit processing may also be performed by activation sever system 110 and/or validation system 130, such as to detect fraud or abuse of indicia, used for accounting purposes, etc., using the aforementioned indicia information during processing of mail items or thereafter.

Processing of indicia which validation system 130 determines to be unactivated may comprise more than rejecting the mail item for delivery. For example, validation system 130, perhaps in cooperation with activation system 110 and/or point of sale system 120, may operate to decrement an appropriate account (e.g., the appropriate users' account, an account of a service provider providing the pre-produced indicia, etc.) or otherwise issue an invoice or collect for the postal value. Collection of postal value in such a situation may not be limited to the actual postage amount, but may include a surcharge associated with misuse of the indicia. Such additional processing may additionally or alternatively include notifying a user of the detected misuse of indicia, statistical analysis of indicia usage (e.g., to detect fraud or attempted fraud), etc.

In addition to or in the alternative to validation system 130 scanning mail items after their introduction into the mail stream, embodiments of the invention may operate to perform at least some level of validation at or very near the time a mail item is introduced into the mail stream. For example, a postman initially picking up a mail item for entry into the mail stream may make a determination as to whether the indicia has been activated (e.g., through reference to one or more visible bi-stable mark, through scanning the indicia, etc.) and/or whether the indicia has the appropriate amount of postage value for the mail item (e.g., through reference to a visible indication of postage value, through scanning the indicia, etc.). Accordingly, the postman may be provided with various devices useful according to embodiments of the invention, such as a portable version of mail piece scanner 133.

From the above it can be seen that operation according to the embodiment of FIG. 2 provides postage indicia for mailing documents, wherein the postage indicia is activated at any of a number of point of sale locations. Embodiments as described herein facilitate implementations which may readily be deployed at point of sale locations, such as retail locations. For example, because neither the postage stock nor the information files used according to embodiments of the invention contain complete or live postage indicia, the loss or theft of either does not result in the loss or theft of postage indicia. Moreover, because the unassigned tokens of the postage stock of embodiments are only activated at a point of sale, the risk of loss, theft, or misuse is minimized.

Moreover, embodiments of the present invention facilitate users conveniently obtaining postage indicia, such as may comprise a number of indicia, a value of postage, a class of service, a type of postage stock, etc. desired, without the user needing processor-based systems, a postage account, etc. Moreover, retail locations and other points of sale are enabled to conveniently stock postage for their patrons without having appreciable monies tied up in an item usually provided for patron convenience and which runs a risk of becoming stale with a change in postal rates. Accordingly, many retail locations, such as grocery stores, drug stores, convenience stores, banks, etc., may readily be utilized to provide point of sale locations according to embodiments of the invention. Moreover, because highly secure client server software is not required according to embodiments of the invention, terminals used in providing activation of postage indicia according to embodiments of the invention may comprise widely available terminal configurations adapted to interface with an activation system as described herein.

Embodiments above have been described with reference to centralized printing of unassigned tokens for distributing to point of sale locations. The concepts of the present invention, however, are not limited to such embodiments. For example, printer 128 of point of sale system 120 may be utilized to print batches of postage stock for retail sale at an associated point of sale location. In such an embodiment, computer platform 121 may interact with activation system 110 to generate appropriate tokens and to store information for use in activating the tokens in unassigned tokens database 114. Detail with respect to processor-based systems cooperating to generate and print information based indicia as may be used as unassigned tokens according to embodiments of the present invention is provided in the above referenced patent applications entitled" System and Method for Generating Postage indicia," "System and Method for Printing Multiple Postage Indicia," and "Computer-Based Value-Bearing Item Customization Security."

Although embodiments have been described herein with reference to the use of printed tokens, it should be appreciated that other forms of tokens may be utilized according to embodiments of the invention. For example, RFID tags may be applied to or embedded in postage stock for use according to the concepts of the present invention.

It should be appreciated that, although embodiments have been described above with reference to use of indicia in a postage context, the concepts of the present invention may be utilized outside of a postal system. For example, indicia according to embodiments of the present invention may be used with respect to various transactions, such as in business commerce.

Although embodiments have been described herein with reference to activating a plurality of postage indicia (e.g., a sheet of postage indicia), it should be appreciated that embodiments of the present invention may be utilized to activate any desired number of postage indicia. For example, a single postage indicia may be activated in an iteration of the flow diagram of FIG. 2, if desired. Postage indicia which are activated according to embodiments of the invention may be part of a larger collection of postage indicia (e.g., 1 postage indicia of a sheet of many postage indicia) or may comprise an independent subset of postage indicia.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for activating a postage indicium for shipment of a postal item at a kiosk, the method comprising:

receiving, via a scanner of the kiosk, information associated with a pre-produced token configured for activation as a value bearing postage indicium for shipment of a postal item to an intended recipient;

determining, by a processor of the kiosk, a postage value for shipping the postal item to the intended recipient; and activating, by the processor of the kiosk, the pre-produced token as value bearing postage based on the postage value, wherein the activating comprises:

receiving full payment from a retail customer, and charging a postage account of an operator of the kiosk an amount corresponding to the postage value, wherein the operator is a third party with respect to: 1) the shipment of the postal item, 2) the retail customer, and 3) the intended recipient, wherein a status of the pre-produced token is changed from unactivated to activated after the postage account of the operator is charged, and wherein activation of the pre-produced token transforms the pre-produced token into a value bearing postage indicium for shipping the postal item to the intended recipient.

2. The method of claim 1, wherein the postage value determined for activation of the pre-produced token comprises a pre-determined postage value.

3. The method of claim 1, wherein the postage value determined for activation of the pre-produced token is determined based on at least one of a weight of the postal item, a postal class for the shipment of the postal item, shipment origination information, destination information, and special handling instructions associated with the shipment of the postal item.

4. The method of claim 1, further comprising scanning, by the scanner of the kiosk, a piece of stock having at least one pre-produced token thereon, wherein the information associated with the pre-produced token is received in response to the scanning.

5. The method of claim 1, further comprising:

receiving, by the processor of the kiosk, shipping information associated with the shipment of the postal item; and sending, by the processor of the kiosk, the shipping information to an activation system configured to record the shipping information in a database.

6. The method of claim 5, wherein recording the shipping information in the database associates the shipping information with the pre-produced token.

7. The method of claim 5, wherein the shipping information comprises at least one of:

information identifying the retail customer;

information identifying the intended recipient; and information associated with a credit card utilized to provide payment for the activation of the pre-produced token.

8. The method of claim 1, wherein the kiosk comprises a scale, the method further comprising:

determining, via the scale of the kiosk, a weight of the postal item; and calculating, by the processor of the kiosk, the postage value based at least in part on the weight of the postal item.

9. The method of claim 1, wherein the kiosk is located at a retail store location, the retail store location corresponding to one of a grocery store, a drug store, a convenience store, and a bank.

10. The method of claim 9, wherein an operator of the retail store location is the operator of the kiosk.

11. A non-transitory computer-readable storage medium storing instructions that, when executed by at least one processor, cause the at least one processor to perform operations for activating a postage indicium for shipment of a postal item at a kiosk, the operations comprising:

receiving information associated with a pre-produced token configured for activation as a value bearing postage indicium for shipment of a postal item to an intended recipient via a scanner of a kiosk;

determining a postage value for shipping the postal item to the intended recipient; and activating the pre-produced token as value bearing postage based on the postage value, wherein the activating comprises:

receiving full payment from a retail customer, and charging a postage account of an operator of the kiosk an amount corresponding to the postage value, wherein the operator is a third party with respect to: 1) the shipment of the postal item, 2) the retail customer, and 3) the intended recipient, a status of the pre-produced token is changed from unactivated to activated after the postage account of the operator is charged, and wherein activation of the pre-produced token transforms the pre-produced token into a value bearing postage indicium for shipping the postal item to the intended recipient.

12. The non-transitory computer-readable storage medium of claim 11, wherein the postage value determined for activation of the pre-produced token comprises a pre-determined postage value.

13. The non-transitory computer-readable storage medium of claim 11, wherein the postage value determined for activation of the pre-produced token is determined based on at least one of a weight of the postal item, a postal class for the shipment of the postal item, shipment origination information, destination information, and special handling instructions associated with the shipment of the postal item.

14. The non-transitory computer-readable storage medium of claim 11, the operations further comprising:

receiving shipping information associated with the shipment of the postal item; and sending the shipping information to an activation system configured to record the shipping information in a database.

15. The non-transitory computer-readable storage medium of claim 14, wherein recording the shipping information in the database associates the shipping information with the activated pre-produced token.

16. The non-transitory computer-readable storage medium of claim 14, wherein the shipping information comprises at least one of:

information identifying the retail customer;

information identifying the intended recipient; and information associated with a credit card utilized to provide payment for the activation of the pre-produced token.

17. A system for activating postage indicia for shipment of a postal item to a recipient using a postage account of a third party, the system comprising:

a kiosk comprising:

a scanner configured to scan a piece of stock having a pre-produced token thereon, wherein the pre-produced token is configured for activation as a value bearing postage indicium for shipment of a postal item to an intended recipient;

at least one processor configured to:

determine a postage value for shipping the postal item to the intended recipient; and activate the pre-produced token of the piece of stock as value bearing postage based on the postage value, wherein, during activation, the at least one processor is configured to:

receive full payment from a retail customer, and charge a postage account of an operator of the kiosk an amount corresponding to the postage value, wherein the operator is a third party with respect to: 1) the shipment of the postal item, 2) the retail customer, and 3) the intended recipient, wherein a status of the pre-produced token is changed from unactivated to activated after the postage account of the operator is charged, and wherein activation of the pre-produced token transforms the piece of stock having the pre-produced token thereon into a value bearing postage indicium for shipping the postal item to the intended recipient; and a memory communicatively coupled to the processor.

18. The system of claim 17, wherein the postage value determined for activation of the pre-produced token comprises a pre-determined postage value.

19. The system of claim 17, wherein the kiosk comprises a scale configured to determine a weight of the postal item, and wherein the at least one processor is configured to calculate the postage value based at least in part on the weight of the postal item.

20. The system of claim 17, wherein the at least one processor is configured to:

receive shipping information associated with the shipment of the postal item, wherein the shipping information comprises at least one of:

information identifying the retail customer;

information identifying the recipient; and information associated with a credit card utilized to provide payment for the activation of the pre-produced token; and send the shipping information to an activation system configured to record the shipping information in a database, wherein recording the shipping information in the database associates the shipping information with the activated pre-produced token.

* * * * *